US006076048A

United States Patent [19]

Gunther et al.

[11] Patent Number: 6,076,048

[45] Date of Patent: Jun. 13, 2000

[54] SYSTEM AND METHOD FOR LEAST SQUARES FILTERING BASED LEAK FLOW ESTIMATION/DETECTION USING EXPONENTIALLY SHAPED LEAK PROFILES

[75] Inventors: John C. Gunther, Bensalem, Pa.; Ke Hong, Kendall Park, N.J.; Paul R. Burgmayer, Wayne, Pa.; Haiwen Chen, Holland, Pa.; Virginia E. Durham, Philadelphia, Pa.

[73] Assignee: BetzDearborn, Inc., Trevose, Pa.

[21] Appl. No.: 08/938,191

[22] Filed: Sep. 26, 1997

[51] Int. Cl.[7] ..... G01M 3/00

[52] U.S. Cl. ..... 702/51; 702/50; 702/45; 395/500.3; 73/40; 73/41.4

[58] Field of Search ..... 702/51, 23, 31, 702/32, 45, 50, 55, 179–181, 190, 182–184, 189, 191, 194, 195, 197, FOR 127, FOR 128, FOR 164, FOR 166; 364/528.01, 16, 528.17, 18; 395/500.27, 3, 500.31; 73/40.5 R, 40, 41.4, 40.7, 45.1, 45.2, 49.1, 861.02, 861.03, 6, 861.356, 195, 196; 165/70; 250/356.1, 302, 551, 557, 558, 386; 436/50, 55, 56; 422/62; 377/21; 706/906, 907, 914, 915, 920; 700/266, 274, 281, 282, 285, 299, 300

[56] References Cited

U.S. PATENT DOCUMENTS

| | | | |
|---|---|---|---|
| 5,315,530 | 5/1994 | Gerhardt et al. | 395/500.3 |
| 5,471,400 | 11/1995 | Smalley et al. | 702/51 |
| 5,756,880 | 5/1998 | Chen et al. | 73/40 |

*Primary Examiner*—Hal Wachsman

*Attorney, Agent, or Firm*—Caesar, Rivise, Bernstein, Cohen & Pokotilow, Ltd.

[57] ABSTRACT

A method and system for detecting and estimating leaks in an industrial boiler whereby the method and system formulate the leak detection problem as a least squares fitting problem, where one or more of the fitted parameters estimate leak flows. The method and system create a representation that incorporates a leak model component, a process model component and a noise model component into the representation. This invention provides a variety of leak $dotproduct_{ij}(tCurrent)=exp(-(tCurrent-tPrevious)/Tau_{ij})*\ dotproduct_{ij}(tPrevious)+(1-exp(-min(t/Current-tPrevious,\ maxDt)/Tau_{ij}))*x_i(tCurrent)*x_j(tCurrent)$.

87 Claims, 17 Drawing Sheets

SYSTEM AND METHOD FOR LEAST SQUARES FILTERING BASED LEAK FLOW ESTIMATION/DETECTION USING EXPONENTIALLY SHAPED LEAK PROFILES

FIELD OF THE INVENTION

This invention relates generally to the field of leak detection in process systems and more particularly, for leak detection in boilers such as black liquor recovery boilers or any other areas where the detection of leak created mass imbalances using on-line measurements is of interest.

BACKGROUND OF INVENTION

Although prior chemical mass balance-based leak detection and water mass balance-based leak detection methods have recognized the importance of process modeling to improve a leak indicator by correcting for otherwise uncharacterized variation, no method has recognized that characterization of leak flow evolution over time is just as important as the system modeling in the extraction of leak-related information. In other words, all sources of variability, whether induced by the system or by the leak itself, must be considered and modeled for detection and estimation purposes. Prior systems limited their attention to models that could be applied at a single instant in time and thus did not make efficient use of all of the data seen to date. In contrast, by incorporating the evolution of the leak over time into the models of the present invention, statistics are created that can efficiently sense leaks that evolve over minutes, hours, or even weeks.

As a result of this failure to incorporate a leak flow model, all prior methods provide just one leak indication statistic. By contrast, the present invention provides a family of statistics, each optimized for the detection of leaks with a specific growth rate. To understand why this is important, it suffices to consider two extreme cases: a slow-growing, small leak and a fast-growing, large leak. Fitting a slow-growing leak profile to the variability associated with a fast-growing, large, leak or vice-versa, results in a poor fit, and, in the extreme case, a reduction of the signal-to-noise ratio to zero. The fact that prior methods were biased towards the detection of leaks with just one growth rate was noted by some practitioners (see *Black Liquor Recovery Boiler Leak Detection: Indication of Boiler Water Loss Using a Waterside Chemical Mass Balance Method*, by Virginia E. Durham, Paul R. Burgmayer and William E. Pomnitz III), but no method of correcting for this bias was proposed; it was viewed as an innate, qualitative property of the method itself.

In contrast, the present invention can provide significance tests that can effectively detect the presence of both slow-growing and fast-growing leaks. Additionally, in the present invention, these families of leak statistics are combined into one aggregate leak detection signal that provides a single overall signal that will detect leaks of widely varying growth rates in the least possible time.

Boiler water leak detection systems/methods that utilize chemical mass balancing are disclosed in U.S. Pat. Nos. 5,320,967 (Avallone et al.) and 5,569,619 (Thungstrom et al.). In particular, the Avallone et al. patent discloses a boiler leak detection system that determines fluctuations in the measured concentrations of an inert tracer in the boiler water for indicating that a water leak is occurring. However, this method/system is limited by having to detect the tracer when the boiler is at steady state. The Thungstrom et al. patent discloses a boiler leak detection system/method that can operate when the boiler is not a steady state, i.e., where process parameters, such as blowdown rate, feedwater rate and concentration of the boiler water tracer, are changing. However, neither of these two patents analyze the leak data or teach how to assess the statistical significance of the leak data.

In *Black Liquor Recovery Boiler Leak Detection: Indication of Boiler Water Loss Using a Waterside Chemical Mass Balance Method*, by Virginia E. Durham, Paul R. Burgmayer and William E. Pomnitz III, there is disclsoed a chemical mass balance leak detection system/method that operates in the presence of normal boiler transients and minimizes impact on normal boiler chemistry. The system/method involves measuring the blowdown flow, measuring the amount of chemical delivered to the system with a calibrated chemical feed system, calculating the expected chemical concentration in the blowdown flow (which incorporates chemical feedrate changes and startup conditions, as well as blowdown flow changes and boiler load transients), measuring the blowdown chemical concentration and comparing the actual concentration to the predicted concentration.

U.S. Pat. No. 5,304,800 (Hoots et al.) also discloses another type of chemical mass balance method for detecting leaks in an industrial water process using a temperature-conditioning fluid and a tracer chemical. However, this patent also does not analyze the leak data.

In U.S. Pat. No. 5,363,693 (Nevruz) there is disclosed a recovery boiler leak detection system and method based on water mass balancing which, among other things, uses a much faster sampling rate (e.g., ⅙ sec) than chemical mass balancing (e.g., 15 minutes). In particular, the Nevruz system/method statistically compares moving average values of the boiler drum balance within a short time interval and a longer time interval. A significant difference between the moving averages is attributed to a possible leak. In particular, three moving window pairs (short, medium, and long) are independently used in the model. See *A Proven and Patented Method to Detect Small Leaks in Recovery Boilers*, by Albert A. Nevruz, TAPPI Proceedings 1995). These three linear filters each represent a difference between a short term average and a corresponding long term average. Because these filters are fixed, they are not readily adaptable to a wide variety of leak, noise and process model situations. For instance, the method has no assumed noise model. Instead, so-called "white" (normally and independently distributed) noise is assumed. Also, the method has no process model to remove artifacts such as steam load effects. Further, there is no assumption of a leak model. This lack of a leak model leads to the situation where leaks of one shape and/or growth rate are preferentially detected over others.

Another boiler leak detection system based on water mass balance is disclsoed in *An Expert System for Detecting Leaks in Recovery-Boiler Tubes*, by John P. Racine & Henk J. Borsje, June 1992 TAPPI Journal. This system looks for a mismatch between the feedwater entering the drum and the steam and blowdown leaving the boiler. However, the expert system is based on a steady state simulation of the boiler. Furthermore, there is no statistical analysis of any leak data mentioned.

Other boiler leak detection systems include acoustic leak detection as disclsoed in *Design and Implementation of a Commercial Acoustic Leak-Detection System for Black Liquor Recovery Boilers*, by Gregory D. Buckner & Stephen J. Paradis, July 1990 TAPPI Journal. This system basically utilizes acoustic transducers for detecting noise levels that exceed basic boiler noise levels for a certain amount of time as being indicative of a boiler leak.

Thus, there remains a need for a boiler leak detection/estimation system and method that provides a family of statistics based upon actual leak flows, each optimized for the detection of leaks with a specific growth rate. Additionally, there remains a need for a boiler leak detection estimation system and method that combines this family of detection signals into a signal easily interpreted by boiler operators.

OBJECTS OF THE INVENTION

Accordingly, it is the general object of this invention to provide an apparatus which addresses the aforementioned needs.

It is a further object of the present invention to provide a system and method for modeling the leak in a process, as well modeling the process itself.

It is still yet another object of the present invention to provide a system and method that utilizes a leak model that incorporates the evolution of the leak over time.

It is yet another object of the present invention to provide a system and method that explicitly estimates the leak flow rates.

It is still yet another object of the present invention to provide a system and method that makes statistically-significant levels of leak flow rate estimates the basis for a leak indicator.

It is still yet another object of the present invention to provide a system and method that integrates the concept of components of variance into a leak estimation procedure.

It is still yet another object of this invention to reduce the leak in a process to a parameter estimation problem.

It is still yet another object of this invention to provide a system and method for formulating a process leak detection problem as an on-line least squares fitting problem, where one or more of the fitted parameters estimate leak flows.

It is still yet another object of this invention to provide a system and method for formulating a process leak detection problem as a combination of off-line and on-line least squares fitting problems, where one or more of the on-line fitted parameters estimate leak flows.

It is still yet another object of this invention for providing a system and a method for estimating leak flows that extract all leak related information from all of the data collected about the process.

It is still yet another object of this invention for providing a system and a method that utilize the special properties of the exponential function so as to make on-line least squares fits practical to use.

It is still yet another object of the present invention to provide a family of practically-realizable leak flow estimation/detection statistics with greater leak resolving power than provided by the prior art.

It is still yet another object of the present invention to provide a family of practically-realizable leak flow estimation/detection statistics that minimize truncation error.

It is still yet another object of the present invention to provide a system and method of leak detection/estimation that can reside on a single small computer or even a stand-along, special purpose device.

It is yet another object of the present invention to provide a system and method that define statistics optimal for detecting both slow-growing leaks and fast-growing leaks.

It is still yet another object of the present invention to provide a system and method that combine this family of practically-realizable leak flow estimation/detection statistics into a single leak detection signal that can detect both slow-growing and fast-growing leaks and can be easily interpreted by boiler operators.

It is still yet another object of the present invention to provide a system and method for detecting leaks that provides for on-line significance testing.

It is still yet even a further object of the present invention to provide a system and method for estimating leak flows with the maximum amount of speed with a minimum loss of sensitivity.

It is still yet another object of the present invention to provide a system and method that utilize data-determined linear filters to provide optimally efficient statistics for a wide variety of leak, noise and process model situations.

SUMMARY OF THE INVENTION

These and other objects of the instant invention are achieved by providing a method and system for detecting and estimating leaks in any conserved flow around an industrial boiler defining a process whereby the method comprises the steps of, and the system comprises means for: (a) measuring mass flow imbalances in the process; (b) partitioning the variability in the measured mass flow imbalances into a process model component, a leak model component and a noise component to form a mathematical representation of a leak in the process; (c) utilizing at least one shape for the leak model component and wherein each of the leak shapes represents a leak that is non-decreasing; (d) fitting the mathematical representation by estimating unknown parameters from the measured mass flow imbalances using least squares filtering to generate an estimated leak flow model; (e) estimating statistical distributions of the parameters to determine their statistical significance; and (f) generating statistics from the at least one leak shape to detect a leak.

DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1A:
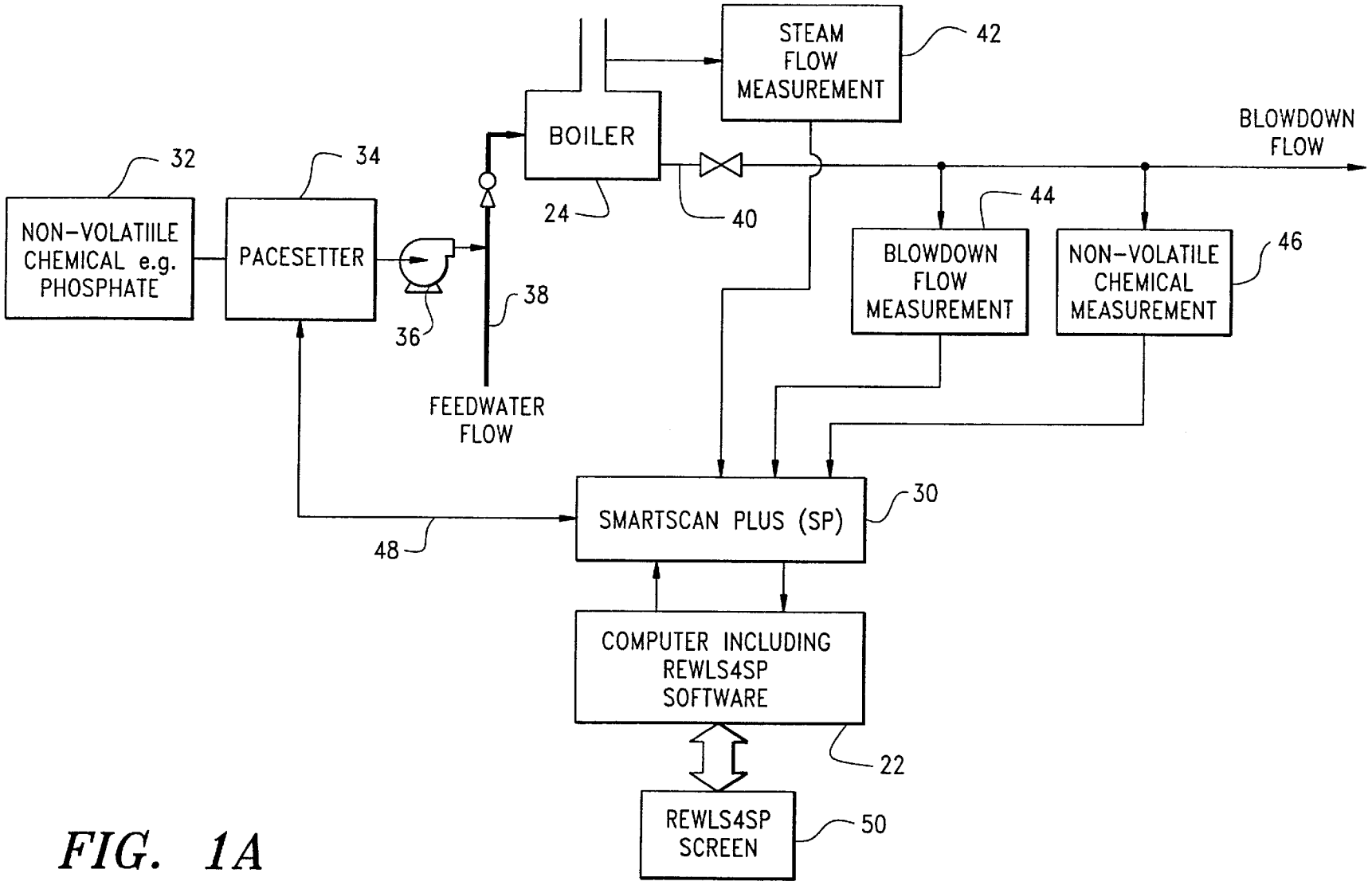
FIG. 1A is a block diagram of the present invention depicting a chemical mass balance configuration.

Least squares fitting can be thought of as a mechanism for partitioning the variability associated with a measured response into components associated with independent (fitted) variables, plus a residual component. Least squares filters, which are essentially on-line least squares fits to a "moving window" of the most recently collected data, can perform such a variability partitioning, or, as it is more commonly known, analysis of variance (ANOVA), on-line. In the present invention, the ANOVA, implicit in a least squares filter, is used to partition the variability associated with the time series mass flow imbalances measured around a process system into three components: (1) a system or process model component; (2) a leak model component; and (3) a residual component.

The process model component explicitly accounts for variability which might otherwise by mistaken for leak induced variability. For example, the process model component might estimate the rate of accumulation of water or a tracer within the system that may not be directly measurable.

The leak model component uses a family of exponentially-shaped models of leak flow growth to capture the leak-induced variability from a wide range of leak profiles, form slow-growing leaks, to rapidly-growing ones.

The residual component contains those sources of variability that cannot be explained by either the process or leak models. If the process model is adequate to capture all process-induced variability, then the residual vector will be a noise sequence. Ideally, the residual component represents a noise sequence that is normally and independently distributed (NID). However, in the real world where the noise sequences are serially dependent (SD), a pre-whitening transformation must be applied to the noise sequences, i.e., to the individual process measurements, before fitting. Application of the pre-whitening transformation guarantees that the resulting residual component is NID, as will be discussed later. See Box and Jenkins, Chapter 11, "Identifying, Fitting and Checking of Transfer Function Models." Suffice it to say for now, that least squares fitting comprises the important property that if the process model is correct and the noise is NID, the least squares parameter estimates extract all of the information about the unknown, fitted parameters of the process model that the data may contain. Pre-whitening transformation parameter estimation can be done dynamically on-line as data is gathered and/or statically off-line using a user-selected portion of historical data.

Given measurements of any conserved flow around a system, plus an appropriate process model (possibly employing associated auxiliary measurements), the present invention could be applied to increase the leak resolving power of these conserved flow measurements in the estimation/detection of leak flows. The derivation of just such an appropriate process model is the subject matter of Ser. No. 08/800,110 (now U.S. Pat. No. 5,756,880) filed Feb. 13, 1997, entitled "Methods and Apparatus for Monitoring Water Process Equipment" assigned to the same assignee, namely BetzDearborn Inc., as the present invention and whose disclosure is incorporated by reference herein.

One such system/conserved flow is a boiler system and an associated non-volatile chemical flow, where the goal is the detection of a boiler water leaks. As noted in *Black Liquor Recovery Boiler Leak Detection: Indication of Boiler Water Loss Using a Waterside Chemical Mass Balance Method*, by Virginia E. Durham, Paul R. Burgmayer and William E. Pomnitz III, a non-volatile chemical provides one of the best possible detection schemes since the signal is magnified by the natural "cycling up" of the boiler water prior to being released in the boiler blowdown. When viewed in chemical mass balance terms, the chemical flow through the steam is zero for a non-volatile flow and so the relative size of the leak flow is "cycle" times larger than for the water mass balance.

Increasing the leak-induced variability only solves one part of the problem; it is also necessary to decrease the size of the process variability masquerading as a leak. For example, the estimation of the tracer mass balance is complicated by the fact that the mass of the boiler water changes with changes in the steaming rate. A process model could incorporate both the boiler mass and the way in which this mass changes in response to steaming rate changes as fitted parameters of the model. By regressing this model to on-line data, the mass and a parameter that express the relationship between the mass and steaming rate changes can be determined on-line, even adapting to slow changes in these parameters themselves over time. Instrumentation level effects, such as systematic errors (offsets) in the devices measuring the non-volatile chemical flows in the boiler, can also be incorporated into the process model; in the most general view, the process model includes not just the process, but also the instruments connected to it. As with the pre-whitening transformation, process model parameter estimation can be performed dynamically on-line and/or statically off-line.

Another such system/conserved flow is a boiler system and an associated flow of water in and out of the boiler where the goal is the detection of boiler water leaks (a water mass balance leak estimation/detection scheme. Water mass balances provide an independent means of determining leaks in parts of the boiler not accessible to a tracer. See Ser. No. 08/528,461 (now U.S. Pat. No. 5,663,489) filed Sep. 14, 1995, also entitled "Methods and Apparatus for Monitoring Water Process Equipment" assigned to the same assignee, namely BetzDearborn Inc., as the present invention and whose disclosure is incorporated by reference herein.

As with the tracer method, one still needs to decrease the influences of the process on the leak detection scheme.

Again, the process model can incorporate both the boiler mass and the way in which this mass changes in response to steaming rate changes, drum level, temperature changes, etc., as fitted parameters of the model. As before, instrumentation level effects can also be incorporated into the process.

The process models described are presumed to apply at every point in time in more or less the same way. In other words, they are relatively time-independent. Leak flows, by contrast, are intrinsically temporal in nature: at one point in time there is no leak but at the next point in time there is a leak. Of equal importance to using either tracer (i.e., chemical mass balance) or a water-based flow is the way the temporal profile of the leak is characterized. For example, if an appropriate leak model for a slow-growing leak were fitted to the data from a fast-growing leak, most of the leak-related variability would end up in the residuals rather than the leak model component. In addition, the slow-growing leak model would pick up more of the leak-like/leak aliasing variability than an appropriately-shaped fast-growing leak model. In general, the leak model's growth rate must match the average growth rate of the specific leak in question if it is to maximize the leak signal captured, while minimizing the leak-like/leak aliasing variability.

The present invention employs a spectrum of exponentially-shaped leak models, each with a different growth rate to provide a range of statistics and each of which is optimized for the detection of leaks at a particular point along this spectrum: exponentials with short time constants for fast-growing leaks and exponentials with long time constants for slow-growing leaks. Note that the same leak, at various points in time after the leak begins, may be best approximated by first one, then another, of these exponentially shapes.

Figure 16:
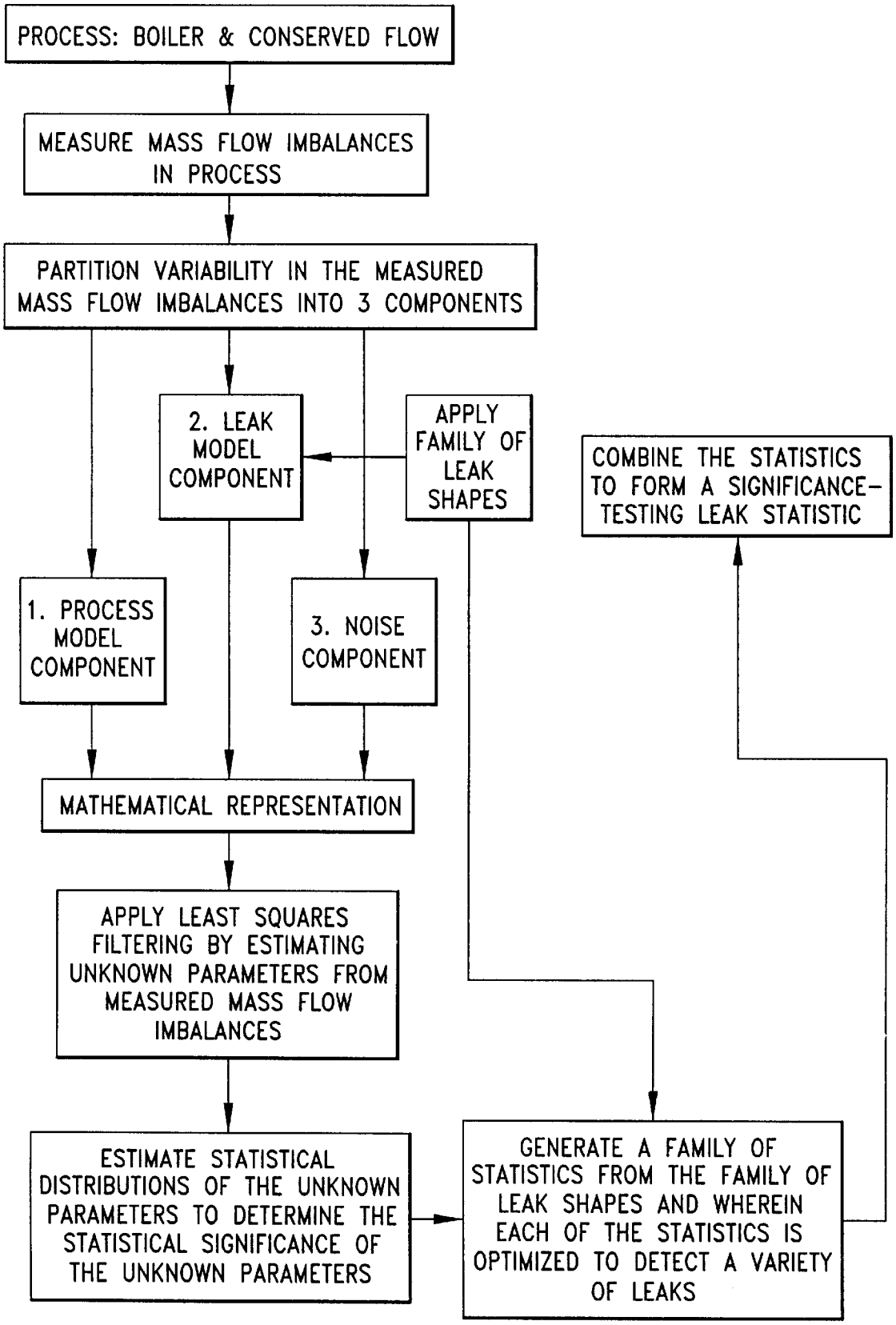
FIG. 16 is a flowchart of the preferred method of the present invention.

This family of exponentially-shaped curves is combined together to form one statistic, a standardized maximum likelihood standardized leak flow (SMLSLF), which effectively combines the range of statistics into a single significance-testing statistic which can be used by the operator as a simple measure of the probability of leaks growing at any rate occurring in the boiler of interest. FIG. 16 provides an overview of the method to obtain this significance-testing statistic. As with noise and process parameter estimation, the leak estimation parameter required for SMLSLF can be calculated dynamically on-line or statically off-line.

These methods have been embodied in a software package called Recursive Exponentially Weighted Least Squares For SmartScan Plus (REWLS4SP or more generally "REWLS"). The key feature of the REWLS4SP software is that the properties of the exponential are used to make it possible to update the least squares fits and to remember the impact of past data in a small amount of time and space, independently of how large a window of data is included in the fits.

Referring now in greater detail to the various figures of the drawing wherein like reference characters refer to like parts, a recursive exponentially-weighted least squares (hereinafter "REWLS") system constructed in accordance with the present invention is shown generally at 20 in FIG. 1A.

The REWLS system 20 basically comprises a computer 22 including the REWLS software which can operate on-line with a boiler 24.

When the REWLS system 20 operates on-line with the boiler 24, the system 20 does so via a computer-based control unit 30, e.g., such as that provided by BetzDearborn, Inc. under the mark SMARTSCAN PLUS (SP), and associated software/firmware, that communicates with the computer 22 including the REWLS software. In this configuration, a chemical mass balance leak detection system and method, the REWLS system 20 comprises a non-volatile chemical (e.g., phosphate or molybdate) reservoir 32, a feedpump controller (not shown) and an associated draw-down assembly (also not shown) that together form the "PaceSetter" 34 (constructed in accordance with U.S. Pat. No. 4,897,797, assigned the sample assignee as this invention, namely BetzDearborn Inc., and whose disclosure is incorporated by reference herein), a pump 36, a feedwater flow 38, the boiler 24 and a boiler blowdown flow 40. Furthermore, a steam flow sensor 42, a blowdown flow sensor 44 and a chemical sensor 46 each measure their respective parameters for providing input to the SP 30. Because of a communication link 48 between the PaceSetter 34 and the SP 30, the SP 30 knows the feed concentration and the feed rate of the non-volatile chemical. Thus, during on-line operation, the REWLS software can obtain the necessary chemical feed flow, blowdown chemical flow, boiler chemical flow, and the steam flow measurements for estimating the leak flow(s), as will be discussed later. In addition, the computer 22 including the REWLS software comprises a screen 50 for displaying all of the pertinent REWLS software related data.

Figure 1B:
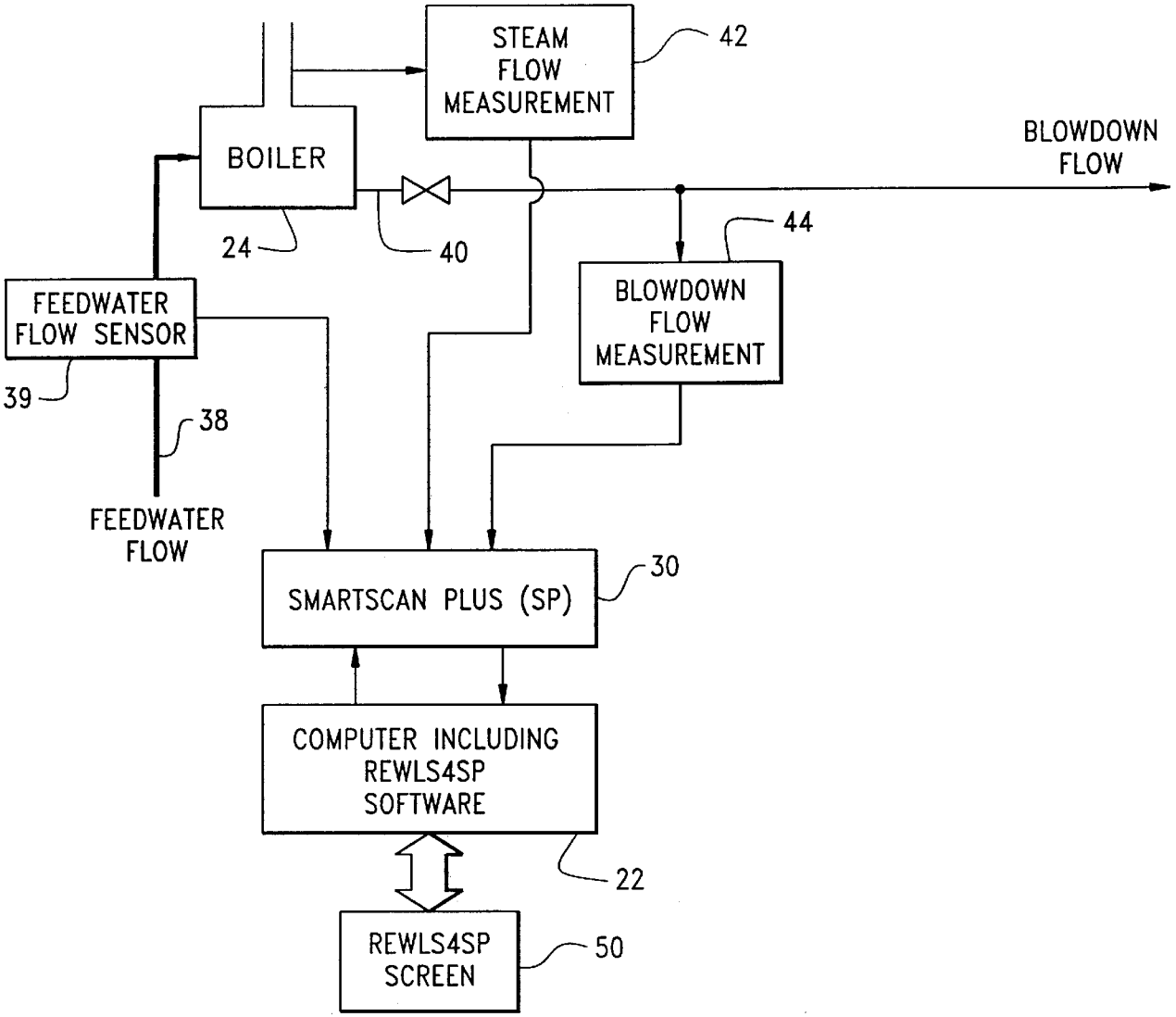
FIG. 1B is a block diagram of the present invention depicting a water mass balance configuration.

Alternatively, the REWLS system 20 can operate on-line with the boiler 24 using a water mass balance configuration, as shown in FIG. 1B. In this configuration, the REWLS system 20 does not utilize a chemical feed path nor a chemical sensor on the boiler blowdown flow, but does include a feedwater flow sensor 39, coupled to the SP 30, for measuring the feedwater flow 38. An attemperation water flow (not shown) also may be included. The steam flow, which may include a soot-blower steam flow, is measured by the steam flow sensor 42. Thus, during on-line operation, the REWLS software can obtain the necessary water flow measurements for estimating leak flow(s), as will be discussed later.

The REWLS software was primarily designed for this on-line operation with the SP 30 and hence the REWLS system 20 is sometimes referred to as "REWLS4SP". However, it should be understood REWLS software is not limited to operation only with the SP 30 but it is within the broadest scope of this invention that the REWLS software can reside on any computer that can be interfaced with industrial boiler 24. Thus, the term REWLS or REWLS4SP is meant to cover any system or method that implements the REWLS software.

The method implemented by the REWLS system software requires: (1) making a sequence of leak assumptions; (2) building a family of leak models, based on those assumptions; (3) collecting boiler-related data to obtain measured sequences; (4) applying a pre-whitening transformation to the measured sequences to account for serially dependent noise; (5) fitting the model to the measured sequences; and (6) reducing the resulting models to a single leak signal. In particular, the leak assumption step requires formulating an intuitive idea about the information that the data contains and how to extract it. Building the leak model step involves constructing a REWLS mathematical model that encompasses the intuitive idea and wherein the model's to-be-fitted parameters, if known, would provide the desired information. The pre-whitening step assures the noise in the measured sequences are as close to being NID as possible. The model fitting step involves using the REWLS software to estimate the unknown parameters and to estimate averages and standard deviations of these parameters to determine their statistical significance. The model reduction step combines these averages and standard deviations into one overall statistic significance indicator that can be easily interpreted by the boiler operator.

1. Introduction to Least Squares Filtering

The most well-known type of one variable linear regression, is, straight line fits to x,y data pairs. Mathematically, such a linear regression determines those parameters, a and b, such that the sum, over all measured x,y pairs, of the squared differences between the model predicted response, ax+b, and the measured response, y, is minimized, or, in other words, providing a least squares fit of the model y=ax+b to the data. Automatically performing/updating such least squares fits to data as it is being collected is known as least squares filtering; the raw data (e.g., x,y) form the filter's inputs and the fitted parameters (e.g., a,b) its outputs.

In practice, since the least squares fits often involve many thousands of data points, such a brute force approach is impractical. The REWLS software uses exponential weights to define the fitting computations recursively; this makes the cost of updating the fit with new data, as well as the amount of disk space and memory the filter requires, independent of the number of data points involved in the fit. The requirement that a least squares filter be automatic, robust, and numerically stable leads to a number of additional practical differences between least squares fitting and least squares filtering.

When the fitted equations are based on physical laws known to apply to the process, least squares filtering provides a powerful tool for extracting useful information, in the form of the fitted parameters, from the process data. For example, suppose that the well-known exponential approach to equilibrium associated with a Continuously Stirred-Tank Reactor (CSTR) is known to govern the changes in boiler water concentrations in response to feed and blowdown flow rate changes. Then, given on-line measurements of (sufficiently dynamic) non-volatile boiler water chemical concentration, chemical feed rate, and blowdown flow rate, a least squares filter could be used to estimate the mass of the boiler water.

2. Ordinary Vectors, Functional Vectors and REWLS Vectors

Ordinary least squares fitting can be expressed in terms of ordinary vectors with a finite number of components. Consider, for example, a linear regression example using the following four x,y pairs:

$$\{(x_1,y_1), (x_2,y_2), (x_3,y_3), (x_4,y_4)\}$$

Next, three vectors, each comprising four components, are introduced:

$$v_0 = \begin{pmatrix} y_1 \\ y_2 \\ y_3 \\ y_4 \end{pmatrix} \quad v_1 = \begin{pmatrix} 1 \\ 1 \\ 1 \\ 1 \end{pmatrix} \quad v_2 = \begin{pmatrix} x_1 \\ x_2 \\ x_3 \\ x_4 \end{pmatrix}$$

then the mathematical model associated with a straight line fit can be written in vector terms as:

$$v_0 = a1*v_1 + a2*v_2 + \text{residuals}$$

Here the vector of residuals is defined as the difference between the values computed by the linear equation and the measured response, y:

$$residuals \equiv \begin{pmatrix} y_1 - (a1*1 + a2*x_1) \\ y_2 - (a1*1 + a2*x_2) \\ y_3 - (a1*1 + a2*x_3) \\ y_4 - (a1*1 + a2*x_4) \end{pmatrix} = v_0 - (a1*v_1 + a2*v_2)$$

Mathematically, the least squares fit determines those values of a1 and a2 such that the sum of the squared residuals is minimized:

$$\text{Minimize: } \|residuals\|^2 \equiv \sum_{i=1}^{4} (residuals_i)^2 = \sum_{i=1}^{4} (y_i - (a1*1 + a2*x_i))^2$$

Geometrically, such a least squares fit determines the projection the response vector, $v_0$, onto the plane "spanned" by all linear combination of the fitted vectors, $v_1$ and $v_2$.

Suppose that, instead of being made up of distinct measurements, the x,y pairs were instead continuous functions of time:

$$\{(x(t),y(t)), \text{ for all } t>=tFirst \text{ and } t<=tCurrent\}$$

Here tFirst and tCurrent define the range of times over which the function is defined (i.e., the times between which measurements of the function are available).

Because vectors with a finite number of components parameterized by an index, i, are analogous to functions with an infinite number of components parameterized by a continuous variable, t, a special, bracket notation is often used to indicate that these functions can be dealt with as vectors. Introducing this notation:

$$v_0 = \langle y(t) \rangle, \; v_1 = \langle 1.0 \rangle, \; v_2 = \langle x(t) \rangle$$

Then, as before, the mathematical model associated with the linear regression can be written in vector terms as:

$$v_0 = a1*v_1 + a2*v_2 + \text{residuals}$$

Again, the vector of residuals is defined as the difference between the values computed by the linear regression equation and the measured response, y(t), only this time written as continuous function of time:

$$\text{residuals} \equiv \langle y(t) - (a1 + a2*x(t)) \rangle = v_0 - (a1*v_1 + a2*v_2)$$

Mathematically, the least squares fit determines those values of a1 and a2 such that the sum of the squared residuals, only this time expressed as an integral, is minimized:

$$\text{Minimize: } \|residuals\|^2 \equiv \int_{t=tFirst}^{t=tCurrent} (residuals(t))^2 * dt = \int_{t=tFirst}^{t=tCurrent} (y(t) - (a1*1.0 + a2*x(t)))^2 * dt$$

In the above, integration over all times for which data is available is conducted.

Geometrically, if the functions are considered as vectors with an infinite number of components (one for each infinitesimal time slice, dt) then the least squares fit can be considered as determining the projection of the response vector, $v_0$=<y(t)>, onto the plane "spanned" by all linear combinations of the fitted vectors $v_1$=<1.0> and $v_2$=<x(t)>.

All REWLS mathematical models/least squares fits are expressed in terms of such infinite dimensional, functional, vectors. However, for reasons to be explained shortly, the functions associated with REWLS vectors are always expressed as the product of a measured function and an exponential multiplier function. The measured function is associated with some measurable physical parameter (e.g., x(t) and y(t)) or else is a constant (e.g., 1.0). The exponential multiplier has the following form:

$$\text{multiplier}(t)=\exp(-(t\text{Current}-t)/\text{Tau})$$

These exponential multipliers are parameterized by a time window, Tau, which in general may be different for each vector, an by tCurrent which is always equal to the current time. Using such multipliers, the vectors associated with the linear regression example can be written as:

$$v_0=\langle y(t)*\exp(-(t\text{Current}-t)/y\text{Tau})\rangle$$

$$v_1=\langle 1.0*\exp(-(t\text{Current}-t)/x1\text{Tau})\rangle$$

$$v_2=\langle x(t)*\exp(-(t\text{Current}-t)/x2\text{Tau})\rangle$$

In the above, the measured functions associated with each vector are y(t), 1.0, and x(t). The corresponding exponential multiplier functions have time windows of yTau, x1Tau, and x2Tau. Note that a REWLS vector is fully defined if the vector's measured function, time window, Tau, and the current time, tCurrent are known. Note also that, since the product of a general function of t with an exponential multiplier function is just another function of t, all of the previous statements regarding linear regressions involving functional vectors also apply to these REWLS functional vectors—the function involved just happens to be the product of two other functions. In particular, if yTau, x1Tau, and x2Tau are chose all equal to some bigTau which is much greater than tCurrent−tFirst, then the exponential multipliers are all approximately 1.0 over the range of integration, and the regression is then essentially the same as the one before the exponential multipliers were introduced.

Exponential multipliers are used for two reasons. First, functions of this form allow one to model the particular processes which form the subject matter of this application; and second, because updating the least squares fits associated with functions that have such exponential multipliers can be done both quickly and easily.

These multiplier functions serve two purposes in the REWLS software. First, these multiplier functions serve a data windowing role, i.e., they can be used to select only a specific number of hours of recent data to be used in the fits. Second, these multiplier functions serve a temporal modeling role, i.e., they can be used to construct models that, in effect, hypothesize that some specific event occurred for a specific number of hours in the past. The temporal modeling role is the direct interpretation of the exponential shape associated with the multiplier function as physically meaningful in and of itself. The fitted parameters of such models estimate the magnitude of the hypothesized event.

The shape of the modeled temporal event need not be exactly exponential for the exponential multiplier function to play a useful temporal modeling role. All that is required is that fitting a model which employs an exponential shape, or perhaps a superposition of several such exponential shapes, can, at some specific time after such an event occurs, capture a significant fraction of the variability associated with the event.

The data windowing role can be exploited if the same value of Tau, DataWindowTau, is used for each vector in the model. As an example, returning to the one parameter linear regression discussed above, the sum of squared deviations to be minimized would be defined as:

$$\int_{t=tFirst}^{t=tCurrent} (\exp(-(tCurrent-t)/DataWindow\ Tau)*(y(t)-(a1*1.0+a2*x(t))))^2*dt$$

Here the common exponential multiplier in each vector's function has been factored out to emphasize the interpretation that residuals form older data have less weight in determining a1 and a2 than those arising from newer data. Thus the exponential multiplier becomes the weighting function for a weighted least squares fit. Because of the way in which the weights decrease for the older data, the fitted parameters tend to be based primarily on data collected in the last DataWindowTau hours or so.

It is often useful to think of REWLS vectors as a product of a single measured function and one or more exponential multiplier functions. For example, a REWLS model that required temporal modeling for one of the vectors and data windowing for the model as a whole would require a product of two exponential multiplier functions in the vector that was used for temporal modeling. If the individual multiplier functions have time windows given by Tau1, Tau2 and Tau3, then, the product of the individual exponential multiplier functions is equal to, and thus can be replaced with, a single exponential multiplier function with time window, productTau given by:

$$\frac{1}{productTau}=\frac{1}{Tau_1}+\frac{1}{Tau_2}+\ldots+\frac{1}{Tau_n}$$

The above formula can be obtained by adding the exponents of the individual exponential multipliers in the product, and then factoring out the common factor of −(tCurrent−t). The above formula can be used to compute the time window for the single multiplier function that equals the product of two or more multiplier functions whose individual time windows are known. In order to facilitate use with particular models, the data can be transformed before fitting using a variety of well-known techniques. For example, the REWLS4SP includes facilities for differentiation, smoothing, and lagging of one sequence relative to another.

The REWLS Model

Having described the concept of REWLS vectors and the differentiation and EWMA pre-filtering transformations that can be applied to their measured functions, the basic form of the models that REWLS software fits is:

$$\sum_{i\ where\ v_i\ not\ fitted} v_i=\sum_{i\ where\ v_i\ is\ fitted} a_i*v_i+residuals$$

In the above each $v_i$ represent a REWLS functional vector which, as described previously, is formed as the product of a (possibly differentiated and/or EWMA pre-filtered) measured function and an exponential multiplier function, that is:

$$V_i=\langle \text{difMeasuredEWMA}_i(t)*\exp(-(t\text{Current}-t)/\text{Tau}_i)\rangle$$

The functional vector of residuals above is defined as:

$$residuals \equiv \sum_{i\ where\ v_i\ not\ fitted} v_i - \sum_{i\ where\ v_i\ is\ fitted} a_i * v_i$$

The REWLS software finds those linear combinations of the fitted vectors that minimize the magnitude of the residuals. In other words, REWLS finds those $a_i$'s such that the following integral of the squared residuals (which, by definition, equals the magnitude of the residuals vector, squared) is minimized:

$$\text{Minimize: } \|residuals\|^2 \equiv \int_{t=tFirst}^{t=tCurrent} \left( \sum_{i\ where\ v_i\ not\ fitted} difMeasuredEWMA_i(t) * \exp(-(tCurrent - t)/Tau_i) - \sum_{i\ where\ v_i\ is\ fitted} a_i * difMeasuredEWMA_i(t) * \exp(-(tCurrent - t)/Tau_i) \right)^2 dt$$

One important special case that can arise is when one of the fitted vectors is an exact, or nearly exact, linear combination of "earlier" (i.e., vectors with lower indexes) vectors. In such cases, the result of fitting the REWLS model is ambiguous, since the linear relationship between the fitted vectors can be used to, for example, express any one of the linearly dependent vectors in terms of the others. In such cases, REWLS keeps the "earlier" fitted vectors (those with lower indexes) in the model, and sets the $a_i$ of any later, linearly dependent, fitted vectors to 0.0.

In general, the ambiguity that such linear dependence introduces, even when the linear dependence is not exact, will tend to inflate the variability of REWLS parameter estimates. It is therefore beneficial to try to arrange things so that each fitted vector is as linearly independent of (or orthogonal to) the others as possible. A simple check on the degree of linear dependence of any two vectors is provided by the REWLS software. A useful strategy for increasing the odds in favor of a particular vector being independent of the others is to place one vector in the model whose Tau is much less than the Tau's of the other vectors.

A useful statistic for diagnosing the amount of the sum of the non-fitted vectors "explained by" each fitted vector in the fit is the R^2 associated with each vector. This partial R^2 is the fraction of the response explained by adding the vector to the fit above and beyond the fraction explained by all fitted vectors with indexes less than the vector added. A low R^2 could be due to co-linearity of that vector with other, lower index fitted vectors, or because that particular variable has little impact on the response. The size of the R^2 associated with a vector can change dramatically if a vector which has previously been highly co-linear with other fitted vectors suddenly begins moving around in ways that distinguish it from the other vectors. Also, it should be noted that vectors that are placed first have "first chance" at explaining variability and their large R^2 may to some extent reflect the fact that they are co-linear with another fitted vector that is really causing the change, but was placed later in the model. To simplify the interpretation of the R^2 associated with each vector, it is recommended that vectors whose impact on the response is likely to be less be placed last.

Efficiently Updating the Least Squares Fit

It should be noted that a more efficient way of updating a least squares fit when functional vectors with exponential weighting, such as in the present invention, exploits the fact that the dot product of two functional vectors, which is defined by the integral of their product, can be approximated as an exponentially weighted sum. This sum can be updated efficiently by using the following equation (in this update formula, the continuous $x_1(t)$ and $x_j(t)$ are approximated as a series of constant functions using their sequences of discrete samples): $dotproduct_{i,j}(t0)=0$ (this initializes the dot product), $dotproduct_{i,j}(tCurrent)=\exp(-tCurrent-tPrevious)/Tau_{ij})*\ dotproduct_{ij}(tPrevious)+(1-\exp(-\min(tCurrent-tPrevious, maxDt)/Tau_{i,j}))*x_i(tCurrent)*x_j(tCurrent)$.

Here tCurrent and tPrevious are the times of the current and previous measurements, maxDt is the longest time between samples before data is declared to be missing, and $Tau_{i,j}=(Tau_i*Tau_j)/(Tau_i+Tau_j)$, where $Tau_{i,j}$ is the tau associated with the exponential weights on each term in the sum. Thus, by having the dot products of all REWLS vectors with each other available, methods of solving for the $a_i$'s that minimize the sum of squares are well-known. The current invention employs modified Gramm-Schmidt Orthogonalization.

The following examples demonstrate the operation of the REWLS method and system 20. The following discussion requires an understanding that any noise sequence in the collected data is, or is as close to being, NID, as explained further below.

Example 1

Improving A Conventional Leak Indicator System Using REWLS

An exemplary conventional leak indicator system is marketed by Nalco Chemical Company of Naperville, Ill. and is based on statistical process control (SPC) monitoring of the concentration of a fluorescent chemical tracer, TRASAR™, in the boiler water of an industrial boiler. However, in this system, there is no quantifying of the connection between the leak flow rates of interest and the concentrations being monitored. On the other hand, by implementing the REWLS method and system 20 in conjunction with the TRASAR™ monitoring, a better definition of leak indicators, as well as an increase in the resolution of such leak indicators, can be achieved.

1. Expressing the Basic Idea:

The basic idea behind Nalco's leak indicator is that assuming otherwise steady state conditions, any real changes in the boiler water TRASAR™ concentration must be due to leaks.

2. Building the Model

To construct a REWLS mathematical model, first the leak assumption is expressed mathematically; in particular, in the example at hand, the conservation of mass is the basis of the above leak assumption which make the connection between TRASAR™ concentration changes and leak flows:

$$-BoilerWaterMass * \frac{d}{dt}(TrasarConc(t)) = TrasarLeakFlow(t)$$

Thus, the assumption of steady-state conditions whereby all other TRASAR™ chemical flows around the boiler (feed, blowdown, etc.) sum to zero. Based again on the assumed steady-state conditions, BoilerWaterMass will also be a constant. Thus, the left hand side is, apart from sign, the rate of change in the total amount of Trasar™ (hereinafter "Trasar") in the boiler water and the right hand side is the mass flow rate of Trasar through the leak. Dividing both sides of the above equation by BoilerWaterMass:

$$-\frac{d}{dt}(TrasarConc(t)) = TrasarLeakFlow(t)/BoilerWaterMass$$

The differences between successive TrasarConc(t) measurements can be used to estimate the derivative on the left hand side, and thus obtain a series statistics which, by assumption, are proportional to the average Trasar leak flow rate between samples. Such sample-to-sample statistics generally provide more detail about the minute-by-minute evolution of the leak flow rate than is required. What is desirable is to combine these individual statistics into some overall estimate of leak flow, such as how much chemical flowed out of the leak since the leak began. In a noise-free world, the individual TrasarLeakFlow(t) estimates could be integrated since data collection began in order to determine the total Trasar mass lost through the leak:

$$\frac{TotalTrasarMassLostViaLeak}{BoilerWaterMass} = \int_{t=tFirst}^{t=tCurrent} \frac{TrasarLeakFlow(t)}{BoilerWaterMass} * dt = \int_{t=tFirst}^{t=tCurrent} -\frac{d}{dt}(TrasarConc(t)) * dt = TrasarConc(tFirst) - TrasarConc(tCurrent)$$

This implies that, apart from a fixed constant equal to the first concentration measurement, the accumulated impact of the leak is contained in the current concentration measurement, which is in agreement with Nalco's recommendation to apply SPC to monitor the Trasar concentration and to interpret "unusual" levels of Trasar, as determined by the SPC procedure, as leaks. However, where measurements are perturbed by noise, uncharacterized TrasarConc(t) variation will tend to build up over time and if nothing is done to correct this, the greater the accumulated impact of such variability will be. Such "stochastic drift" could be due to gradual instrument miscalibration over time or, as is more likely, to the accumulated impact of deviations from the assumed steady-state conditions. Thus, the method of just adding up all of the changes in concentration since data collection began results in a statistic that reflects the accumulated impact of all of the noise since data collection began as well. This stochastic drift would not be such a problem if there really were a leak for all the time over which these changes in concentration were summed. Then, although the same level of stochastic drift would occur, more leak signal would be entering into the sums, and, eventually, this leak signal should dominate the noise, since the accumulated impact of the leak on concentration is additive, whereas much of the stochastic drift will tend to cancel out. The real problem is in giving the concentration time to drift randomly over long periods in which there is not any leak, which adds noise without adding any signal to make up for it.

Therefore, to minimize the impact of such drift, ideally, the accumulated change in Trasar concentration since the leak began, would be calculated. Although it is not known when the leak began, it is known that at some time after the leak begins, it will have begun 1 hour ago, 2 hours ago, etc. Thus, (1) to avoid the problem of including too much "no signal" data in the statistics while at the same time (2) not losing much of the valuable data from periods when there really is a leak, a family of such accumulated Trasar flows is defined, each of which will "kick in" with a maximum signal-to-noise ratio at a time, after the leak begins, equal to the length of the data window over which it is summed. In practice this permits the detection of larger leaks quickly (via the sums over the shorter windows) while at the same time catching the smaller leaks eventually, when their accumulated impact (as indicated by the sums over the longer windows) is sufficiently large to be seen above the stochastic drift.

At this point, it is more useful to consider the average Trasar flow rate through the leak over a certain period of time rather than to consider the total mass of Trasar that flowed out of the leak over that certain period of time. This average is more commonly referred to as the 1, 2, etc. hour moving averages of the Trasar leak flow rate. The reason is that, mathematically, it is just a matter of dividing or multiplying by a constant, the data window size (in hours), to convert from sums to average flow rates and visa-versa. Such an average is a least squares estimate of the Trasar leak flow rate, under the hypothesis that the leak began the specified number of hours ago, and was a fixed constant thereafter (i.e., that it had the shape of a step function). In other words, given the succession of changes in concentration that were actually observed, along with the assumption that the leak began the specified number of hours ago, no other statistic purporting to estimate the unknown constant leak flow rate of this model is in closer agreement, in the sense of least squares, with the actual data obtained than the corresponding moving average.

Performing such averages (i.e., the 1, 2, etc., hour moving averages) represents a tacit assumption that the leak has the shape of a step function: if a different leak profile been hypothesized, then the simple, equal weight averaging the last 1, 2, etc. hours of data would not have produced the best (in the least squares sense) overall leak flow estimate. To produce such a least squares estimate with a non-square hypothesized leak flow profile, would have required weighing those points with the hypothesized smaller leak flows less, since, by hypothesis, they would have contained less of the total leak flow information of interest. As a result, some assumptions about the basic shape of TrasarLeakFlow(t) have to be made in order to generate statistics that combine the individual, sample-to-sample leak flow estimate into a single statistic that estimates overall leak flow. Some possible leak flow shapes that might be used for this purpose include:

1. The Step: The leak began a specified number of hours ago, and continued at a to-be-determined constant flow rate thereafter. (This is the example already considered, wherein 1, 2, etc., hour moving averages provide the least squares estimates of the to-be-determined constant).
2. The Ramp: Leak is zero up to a specified number of hours ago, after which it grows linearly up to a to-be-determined current flow rate.
3. The Exponential: leak grows with a specified relative growth rate (e.g., doubling every so many, specified, hours) up to a to-be-determined current flow rate.

Figure 2:
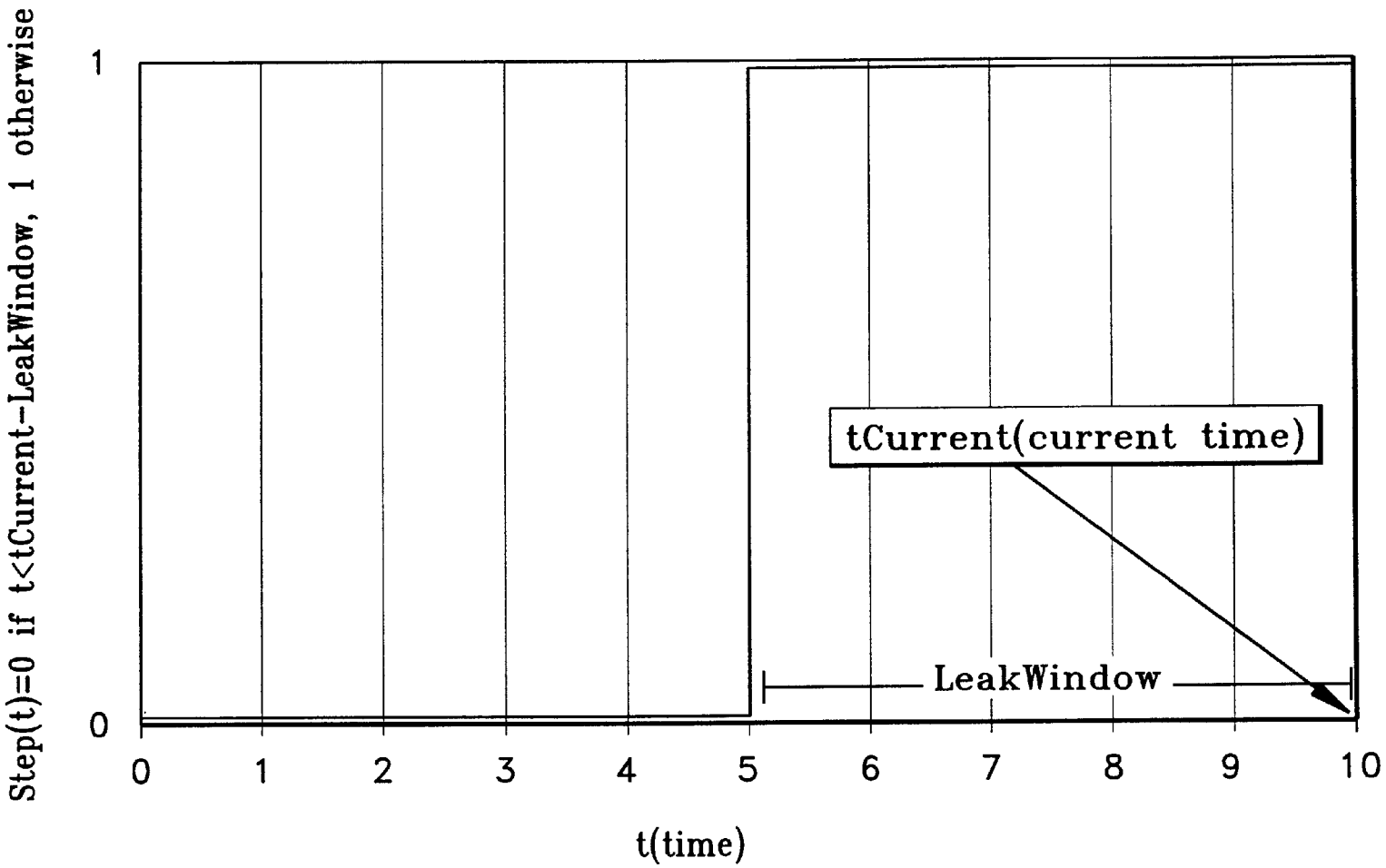
FIG. 2 is a step function depicting one possible form for a leak flow (t)
Figure 3:
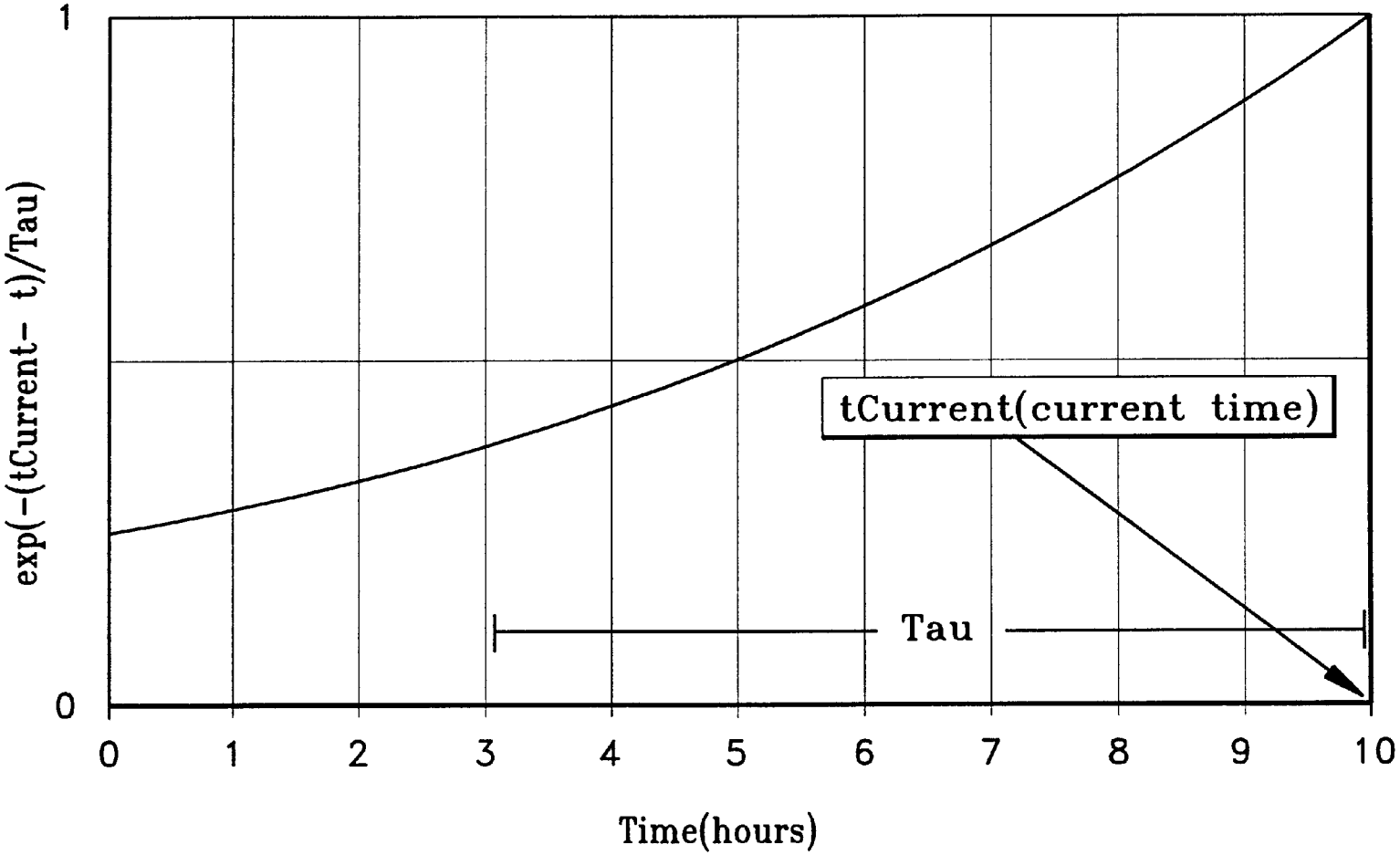
FIG. 3 is the exponential form of the leak flow (t) required by the present invention.

This list of shapes could be extended indefinitely. Moreover, it is important to realize that each of the above basic leak shapes actually represents a family of shapes, parameterized by either how far back in time they presume the leak to have begun, or, in the case of the exponential (and what amounts to the same thing) by the specified relative growth rate of the hypothesized leak. The first of the above shapes, the step, is depicted in FIG. 2. In order to make the computations manageable, the REWLS software limits the user to only one such shape, the exponential, as pictured in FIG. 3. Mathematically, exponential leak flow shapes can be represented by the following equation:

$$\text{LeakFlow}(t)=\text{CurrentLeakFlow}*\exp(-(t\text{Current}-t)/\text{Tau}) \quad (1)$$

Here tCurrent is the current time, t is any time less than or equal to tCurrent, Tau is a parameter that characterizes the relative growth rate (which in effect determines how long ago the leak began) and CurrentLeakFlow is the current leak size, to be determined by least squares fitting of the exponential function to each estimated concentration derivative obtained from each adjacent pair of TrasarConc(t) samples:

$$-\frac{d}{dt}(TrasarConc(t)) = a * \exp(-(tCurrent - t)/Tau)$$

The fitted constant, a, represents the CurrentLeakFlow estimate divided by the fixed constant, BoilerWaterMass. Note that each time new data comes in, tCurrent increases, and we will have to compute a new value of the least squares fitted parameter, a. Performing such fits for a variety of Tau's, a family of statistics is obtained that correspond to the same series of moving averages of TrasarConc(t) derivatives over different time windows described previously, except this time using exponential weights, rather than step-shaped weights. Specifically, it can be shown that, apart from a factor of ½, the fitted parameter "a" equals the Exponentially Weighted Moving Average (EWMA) of the estimated Trasar concentration derivatives, using a time window equal to Tau.

At this point, one may question the preference of the exponential over the step function, or any other specific hypothesized leak flow shape since the actual leak shape is unknown. However, selecting one of the above three leak shapes is a reasonable first approximation and if a range of time windows is selected and then the associated models are fit to the measured data from actual leaks, these models are likely to provide a family of reasonably efficient statistics for leak flow rate estimation, each one optimized for a specific time after the leak begins. Such statements are tacitly based on the following leak flow shape heuristic:

Leak Flow Shape Heuristic: Leak flows evolve in a reasonably smooth, generally increasing, manner over time.

The above heuristic denies the existence of, for example, real-world leak flow shapes that are composed of numerous, widely separated, tall spikes of short duration. Fitting the exponential shapes to data corresponding to such discontinuous leak flow shapes would not provide a statistically efficient estimate of overall leak flow, since it would involve averaging the few data points where real leak flow was present (e.g., the spikes) with the many, variability inflating, data points collected during the times between the spikes. If a leak shape hypothesis assumed "sparse sharp spikes" (although somewhat far-fetched from reality), then a different family of statistics, e.g., the average of the largest 1% of the TrasarLeakFlow(t) estimates over a specified time window, would likely have a greater signal to noise ratio than the exponential. In general, different assumption about leak shapes lead to different "optimal" statistics.

Although it is only an heuristic, not a fact, there is a long enough tradition in statistical model building of making similar assumptions regarding the shapes of the fitted functions, and, in particular, in the use of simple mathematical functions to capture first approximations thereof, that any family of shapes that is consistent with this heuristic and allows one to create statistics that are optimized for detection at various times after the leak starts, will likely provide acceptable statistical efficiency. Thus, since there are so many reasonably good shapes to choose from, the exponential can be chosen to make the computation manageable.

3. Fitting the Model

In the previous section, a family of models parameterized by Tau was developed which needs to be fitted to the measured sequences of Trasar concentrations. At any point in time, tCurrent=t(N), the goal is to find the unknown parameter "a" such that the sum of the squared deviations between the left and right hand sides of the equations below is minimized:

$$-\frac{d}{dt}(TrasarConc(t(N))) = a * \exp(-(tCurrent - t(N))/Tau)$$

$$-\frac{d}{dt}(TrasarConc(t(N-1))) = a * \exp(-(tCurrent - t(N-1))/Tau)$$

$$-\frac{d}{dt}(TrasarConc(t(N-2))) = a * \exp(-(tCurrent - t(N-2))/Tau)$$

$$\vdots$$

$$-\frac{d}{dt}(TrasarConc(t(2))) = a * \exp(-(tCurrent - t(2))/Tau)$$

$$-\frac{d}{dt}(TrasarConc(t(1))) = a * \exp(-(tCurrent - t(1))/Tau)$$

In the above, t(1)=tFirst, t(2), . . . t(N)=tCurrent represent the times at which TrasarConc(t) has been samples; for simplicity it should be assumed that the time between samples is equal and there are no missing data. Such systems of equations can be expressed in a more compact form using a "functional vector" notation:

$$\left\langle -\frac{d}{dt}(TrasarConc(t)) \right\rangle = a * \langle \exp(-(tCurrent - t)/Tau) \rangle$$

The brackets are meant to indicate that the function is treated as a vector which has as many components as there are equally spaced sample points. Preferably, these functional vectors can be considered as "infinite dimensional", i.e., as having a component for every value of the time, t. From this perspective, the samples merely permit the approximation of the underlying continuous "functional vector". The approximation is made by assuming that, in the intervals between samples, the function's values equal the average of the samples that bracket the interval.

In the REWLS software, every such functional vector is expressed as the product of two functions: (1) a measured function and (2) an exponential multiplier function. Since the model has no exponential multiplier for the left hand vector, and no measured value for the right, an exponential with a very large Tau is introduced for the multiplier of the left hand side vector, and "1.0" for the measured function of the right hand vector, in order to obtain a REWLS compatible form of the model:

$$\left\langle -\frac{d}{dt}(TrasarConc(t)) * \exp(-(tCurrent - t)/BigTau) \right\rangle = a * \langle 1.0 * \exp(-(tCurrent - t)/Tau) \rangle$$

(As long as BigTau is much larger than Tau, the difference between fitting this model and the fitting the original model will be negligible).

In terms of this vector notation, the least squares fitting problem can be expressed as the minimization of the distance between the left and right hand side vectors, by variation of the scalar "a", that is:

find a such data:

$$\left\|\left\langle -\frac{d}{dt}(TrasarConc(t)) * \exp(-(tCurrent - t)/BigTau)\right\rangle - a * \langle 1.0 * \exp(-(tCurrent - t)/Tau)\rangle\right\|^2$$

is a minimum.

In other words, what is sought is that multiple of the right-hand side vector that most closely approximates the left-hand side vector, in a least squares sense. Geometrically, what is sought is the orthogonal projection of the left-hand side vector onto the right-hand side vector.

Figure 4:
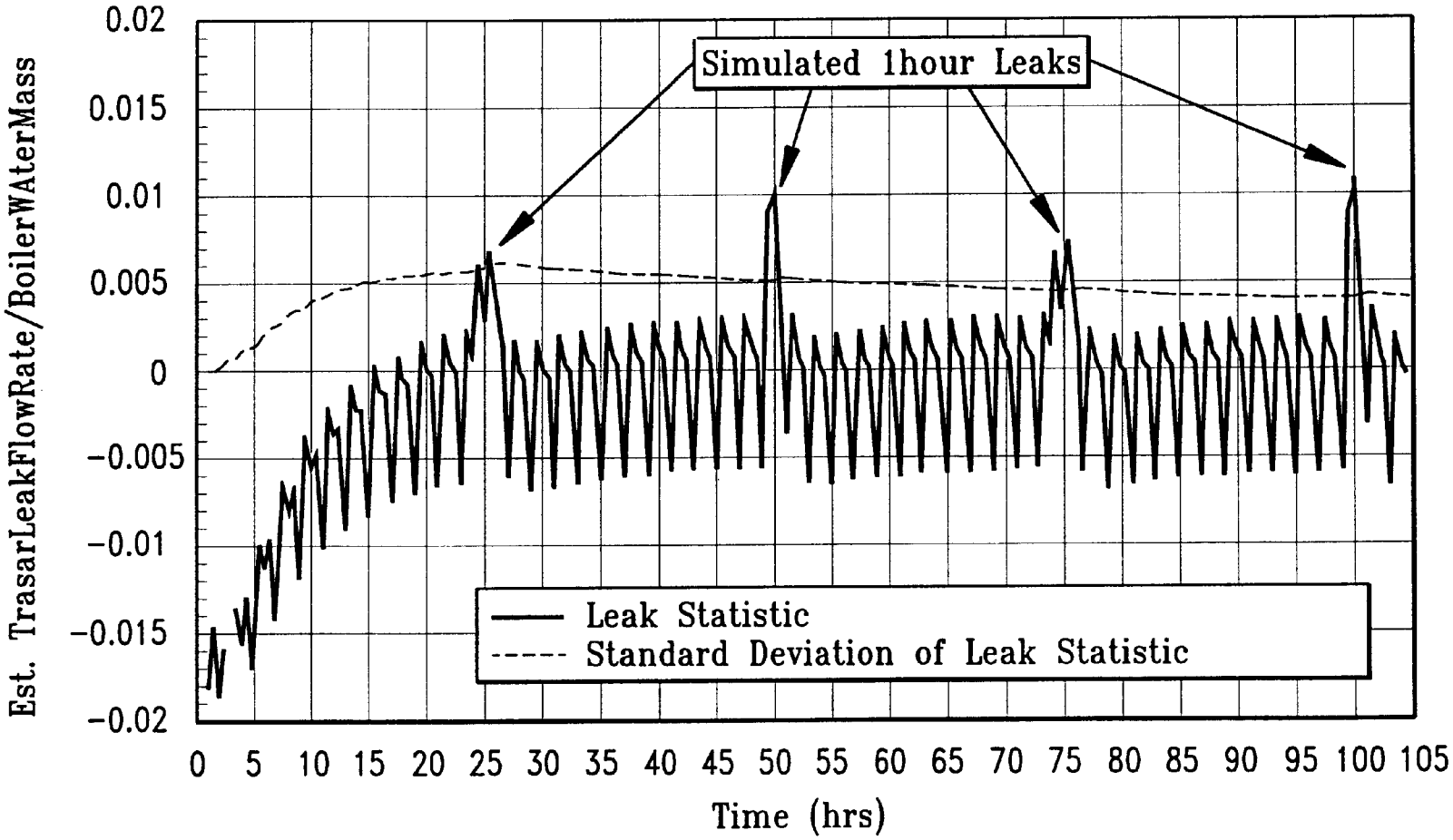
FIG. 4 is the mathematical leak model of Example #1 assuming steady state boiler conditions.

As shown in FIG. 4, in the initial part of the simulation, the concentration increases as the boiler concentrations cycle up to their steady-state levels from their initial level of 0.0. These rapid initial increases in concentration are picked up as a "negative leak flows" by the statistic; this is an example of how deviations from the assumed model (in this case, the assumed steady-state conditions; lead to "leaks" which are in fact artifacts of the model mismatch. The rest of the variation in the statistic arises from concentration changes due to the following sources:

1. Feed rate changes every ½ hour;
2. Blowdown rate changes every two hours;
3. A one hour leak introduced at the end of each 25 hour period;
4. Steaming rate changes every 50 hours;

The leak estimating statistic reflects a kind of superposition of the concentration changes due to each of the above sources of concentration change.

Note how the estimated standard deviation of the statistic begins very small, gradually increases, and then declines. In the beginning, the standard deviation estimates rest on just the handful of leak statistics collected so far, which tend to be close together and lead to a smaller standard deviation estimate. Just after the boiler has cycled up, the average estimated variability peaks, reflecting the large concentration changes associated with cycling up. Later, when the concentrations stabilizes, background variability is reduced, on average, due to the inclusion of more points with smaller variability than during the initial period.

Figure 5:
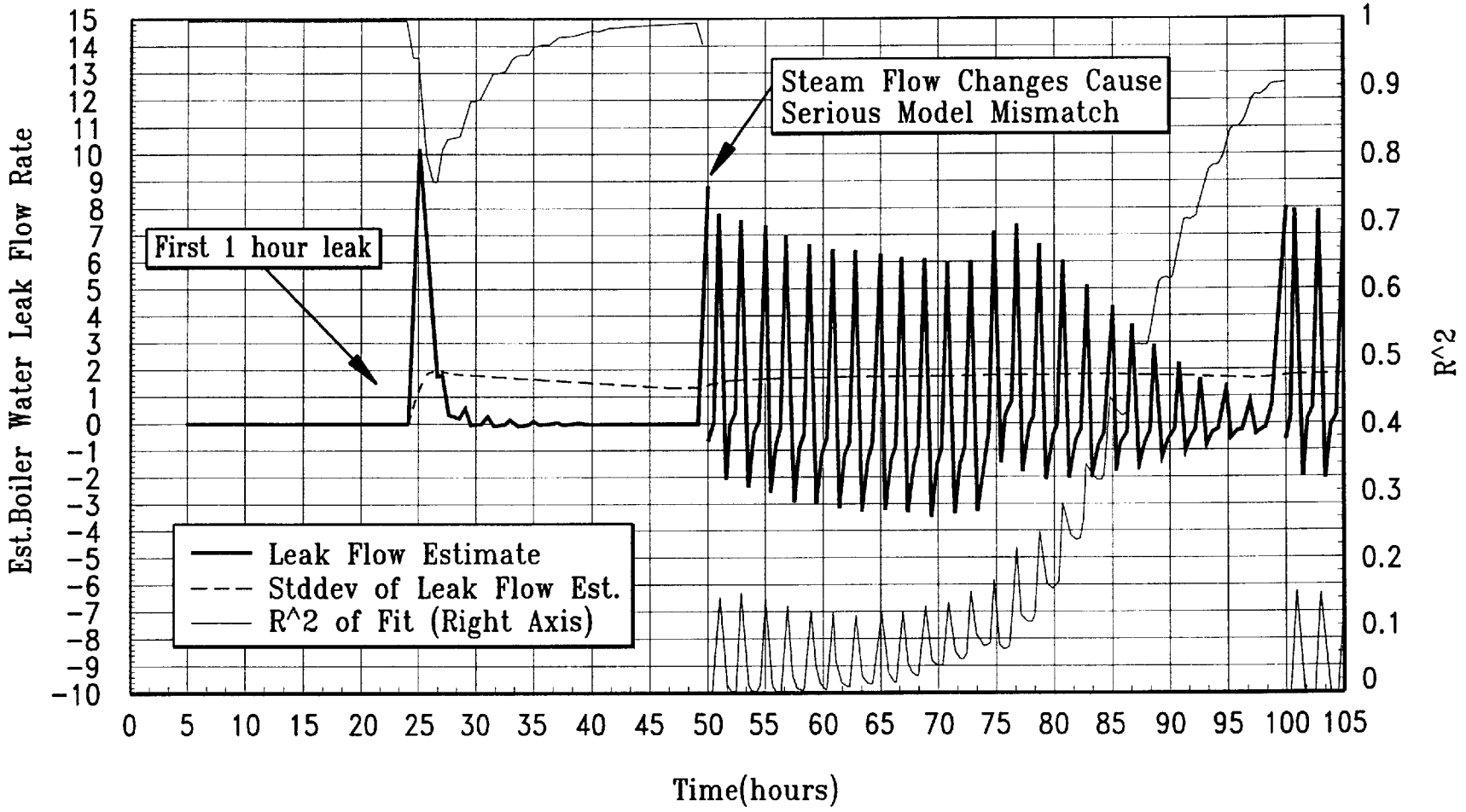
FIG. 5 is the mathematical leak model of Example #2 based on model mismatch due to leak swings-induced concentration changes.

It is worth noting that FIG. 5 shows that the leak statistic was never statistically significant at the three standard deviation level, except for the "negative leak" period during startup. The fault is not in the statistics, but in the mismatch between the simplistic Nalco assumptions and the dynamic model that generated the data used. As will be seen below, the exact same simulated data sequence, when matched with a more detailed REWLS process model, produces highly significant leak flow estimates, and eliminates the incorrect negative leak flows during start up.

In summary, Example #1 began with a vague idea that "unusual changes in boiler water concentration indicate leaks". At this point, a specific estimate of chemical leak flow rate has been obtained, under specific model assumptions. Thus, by applying the principles of REWLS to the original Nalco concept of using SPC to track boiler concentration levels, both the meaning of the resulting leak flow estimate/leak indicator has been clarified and the variability in the resulting leak flow estimate/leak indicator has been reduced.

Example 2

A REWLS Compatible Chemical Mass Balance Model

To account for much of the variability that the basic assumption made in Example #1 consigns to the background noise, a more detailed process model is utilized in this example, thereby decreasing the variability of the leak flow estimates.

1. Expressing the Basic Idea:

Although there have been many variations on this basis theme, the idea behind many of the approaches considered by the Assignee could be stated as follows:

BetzDearborn Chemical Based Leak Indicator (CBLI) Idea: Any variation in boiler concentration that cannot be accounted for in terms of the equations of a Continuously Stirred-Tank Reactor (CSTR) must be due to a leak.

2. Building the Model

Consider the differential mass balance equation that relates the chemical flows around a boiler modeled as a Continuously Stirred-Tank Reactor (CSTR) with perfect mixing:

$$\frac{d}{dt}(BoilerMass(t) * BoilerConc(t)) = FeedConc(t) * FeedFlow(t) - BoilerConc(t) * (BlowdownFlow(t) + LeakFlow(t)) - SteamFlow(t) * SteamConc(t) \quad (2)$$

This equation states that the rate of increase in the total mass of a chemical in the boiler water equals the net flow rate of chemical into the boiler water. For simplicity, it will be assumed that the chemical flow through the steam is 0.0, as would be approximately true for non-volatile chemicals. It is also assumed that direct measurements of all series except BoilerMass(t), the mass of the boiler water, are available. An initial assumption is made that BoilerMass(t) is a fixed, but unknown, constant, M.

With these assumptions, equation (2) simplifies to:

$$M * \frac{d}{dt}(BoilerConc(t)) = FeedConc(t) * FeedFlow(t) - BoilerConc(t) * (BlowdownFlow(t) + LeakFlow(t)) \quad (3)$$

Substituting the exponential leak flow shape (equation 1 from the Example #1) into equation (3), for LeakFlow(t), equation (3) become:

$$M * \frac{d}{dt}(BoilerConc(t)) = FeedConc(t) * FeedFlow(t) - BoilerConc(t) * (BlowdownFlow(t) + L * \exp(-(tCurrent - t)/LeakTau)) \quad (4)$$

Note that there are two undetermined parameters in this model, the presumed constant boiler water mass, M, and the estimated leak flow rate, L. As in Example #1, the exponential weights, which for all practical purposes was 1.0 could be introduced at this point; however, it is assumed that the boiler water mass changes slowly over time and that, therefore, it is desirable to have the current estimate of boiler water mass based on the last FitTau hours worth of collected data, rather than on all past collected data. In this case, to fully specify the REWLS model, in addition to LeakTau, FitTau must be chosen which represents the characteristic time that will, in accordance with the exponential multiplier functions of the associated REWLS vectors, determine how quickly older data is "forgotten" relative to more recent data:

$$\text{Weight}(t) = \exp(-(t\text{Current} - t)/\text{FitTau}) \quad (5)$$

Note that FitTau should be chosen such that the independent variable experience variations sufficient for proper estimation of the corresponding fitted parameter. Multiplying both sides of equation (4) by the above exponential weights, results in the following:

$$\exp(-(t\text{Current}-t)/\text{FitTau})*M*d/dt(\text{BoilerConc}(t))=\exp(-(t\text{Current}-t)\text{FitTau})*\text{FeedConc}(t)*\text{FeedFlow(t)}-\exp(-(t\text{Current}-t)/\text{FitTau})*\text{BoilerConc(t)}*\text{BlowdownFlow(t)}+L*\exp(-(t\text{Current}-t)/\text{FitTau})*\exp(-(t\text{Current}-t)/\text{LeakTau})*\text{BoilerConc}(t) \quad (6)$$

As described earlier, in order to enter this model into REWLS, what is required is a single exponential multiplier function associated with each of the model terms above; therefore, it is necessary to rewrite the product of exponents in the last line of the above equation as:

$$\exp(-(t\text{Current}-t)/\text{FitTau})*\exp(-(t\text{Current}-1)/\text{LeakTau})=\exp(-(t\text{Current}-t)/\text{FitTau}-(t\text{Current}-t)/\text{LeakTau})=\exp(-(t\text{Current}-t)(1.0/\text{FitTau}+1.0/\text{LeakTau}))=\exp(-(t\text{Current}-t)/\text{FitLeakTau})$$

Where, in the last line above, is defined:

$$\frac{1}{FitLeakTau} \equiv \frac{1}{FitTau} + \frac{1}{LeakTau} = \frac{FitTau + LeakTau}{FitTau * LeakTau} \quad (7)$$

Substituting this single exponential multiplier function for the product of multiplier functions in (6), and rearranging:

$$<\text{FeedConc(t)}*\text{FeedFlow}(t)*\exp(-(t\text{Current}-t)/\text{FitTau})>-(\text{FeedChemFlow})$$

$$<\text{BoilerConc}(t)*\text{BlowdownFlow(t)}*\exp(-(-(t\text{Current}-t)/\text{FitTau})>=(\text{BlowdownChemFlow})$$

$$M*<d/dt(\text{BoilerConc(t)})*\exp(-(t\text{Current}-t)/\text{FitTau})>+(\text{BoilerChemFlow})$$

$$L*<\text{BoilerConc}(t)*\exp(-(t\text{Current}-t)/\text{FitLeakTau})>(\text{LeakChemFlow}) \quad (8)$$

The terms above have been rearranged so as to place the non-fitted or response vectors on the left side of the equation and the fitted or predictor vectors on the right; this form is required by REWLS conventions. To the right of each term is a user selected name; these names are used to refer to the individual model terms below. The model is now in the form required to enter it into REWLS: each "functional vector" has both a measured function and an exponential multiplier function associated with it. Note one subtle difference from Example #1: rather than the mass flow of a chemical, this model instead contains a parameter that estimates boiler water leak flow directly. The previous formulation in terms of a chemical flow directly. The previous formulation in terms of a chemical flow was used to keep the REWLS model as close to the recommended "SPC tracking of Trasar concentration" as possible. However, since what is most desirable is the boiler water leak flow, not chemical leak flows, the flexibility that REWLS provides to formulate this new model permits this quantity to appear directly.

3. Fitting the Model

The REWLS software can generate simulated leaks consistent with the above model. The following examples are based on such data.

Other important parameters that define the simulation are the chemical concentration of the feed tank, which by default is 1.0, the boiler water mass, which by default is 100.00 mass units, and the initial concentration of the boiler water, which by default is 0.0. Concentrations are expressed as mass fractions, e.g., the total mass of chemical in the boiler water equals the boiler concentration times the boiler water mass.

The differential equation that governs the model is essentially that of equation (3) with asymmetric square waves substituted for FeedFlow(t), BlowdownFlow(t), and LeakFlow(t). One exception is the impact of SteamFlow(t) on the BoilerMass(t), which will be considered later.

Figure 6:
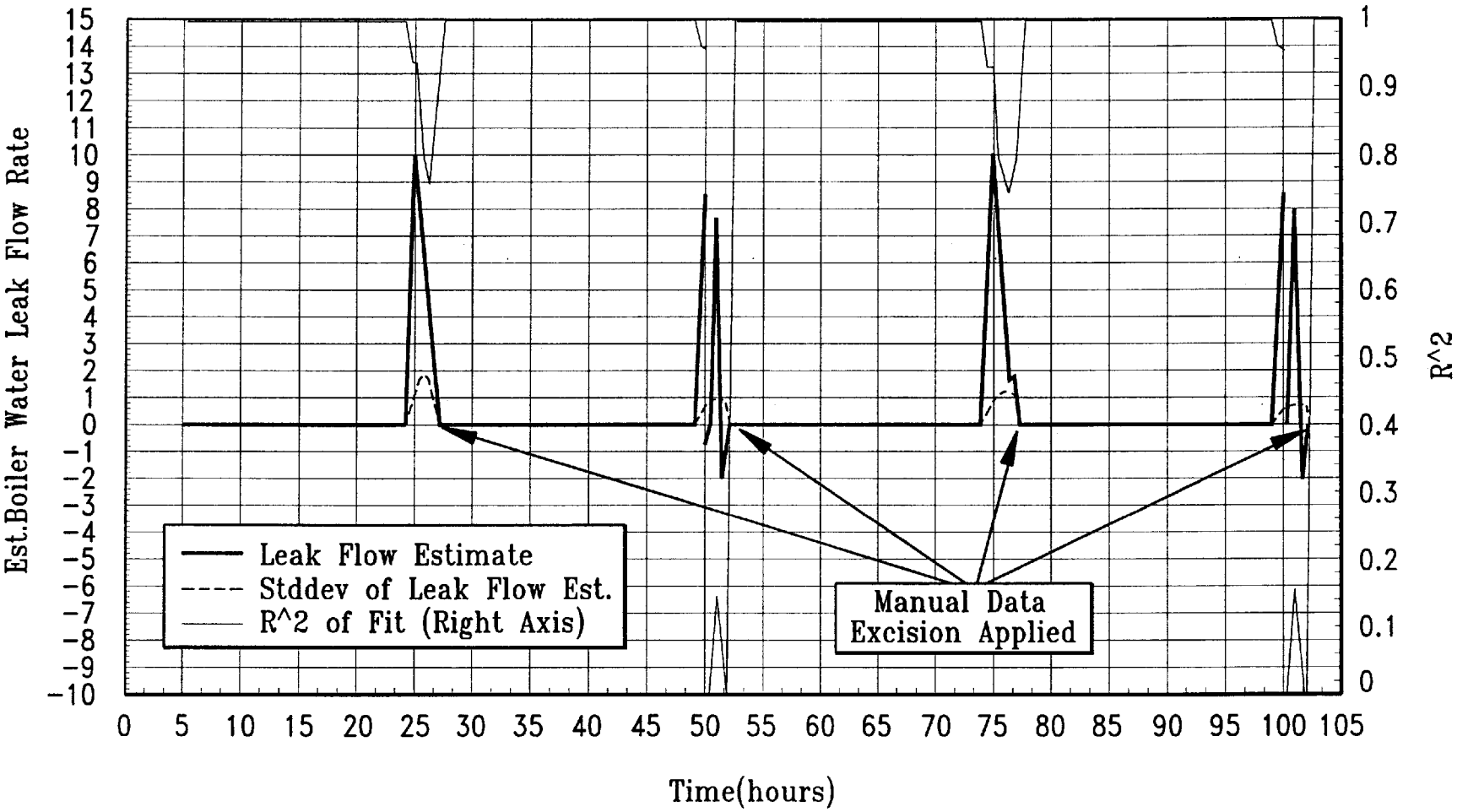
FIG. 6 is the mathematical leak model after manual data excision has been applied.

The results of the current model are shown in FIG. 6. As can be seen, for the first 24 hours of the run, the leak flow estimate is 0.0 and its standard deviation is so small that it is practically 0.0. In addition, during this period, the fitted parameter that represents the boiler water mass is almost exactly 100.00, the true value. Furthermore, during the first simulated leak, highly statistically significant leak flow rates were obtained. It should be noted that there is no longer a perfect fit, especially after hour 25, because the 1 hour square leak flow pulse of the simulator does not fit all that well to the one hour exponential leak shape of the REWLS model. Nonetheless, this shape mismatch does not prevent the estimated leak flow rate at hour 25 from achieving close to the actual leak flow rate used in the simulation (10.0).

At hour 50, however, something goes seriously wrong. Evidently, the model being fitted to the data breaks down in the presence of the steam flow induced concentration changes. In particular, here is what happened. The steam flow increase at hour 50 introduces around a 1% increase in the boiler water concentration which is not associated with any change in the flows into/out of the boiler. The only way the current model can account for such a rapid increase is by assuming a much smaller boiler water mass than the true boiler water mass. Although such a smaller mass better accounts for the changes due to the steaming rate induced concentration changes, it cannot account for the ordinary concentration changes that were captured so well by the model using the correct boiler water mass. In other words, just by adjusting mass alone one cannot account for all the concentration variation seen, let alone coming close to the concentration variation. The uncharacterized flow associated with the use of an unreasonably small boiler water mass estimate are picked up as "leaks"; the size of such uncharacterized flows depends upon the net flow of chemical into the boiler, which changes with blowdown flow rate-hence the regular up and down variation in the leak estimate seen as blowdown flow changes. Thus, a few outliers which do not match the model during times of steaming rate changes are distorting the entire fit. In the next section the model will be revised so that it incorporates the steaming rate inducted void fraction changes that are at the heart of this problem.

Suppose, however, that all that was known was that in the presence of steaming rate changes, the model no longer works. The model could still be used, provided that the data, where steam load was changing from the fit, were removed. The REWLS software permits the operator to throw away the last "Backup" hours of data whenever serious model mismatch is suspected. The graph shown in FIG. 6 depicts how the model changes when operator intervention, at hours 25, 50, 75 and 100, is assumed to throw away the data inconsistent with the model.

Figure 7:
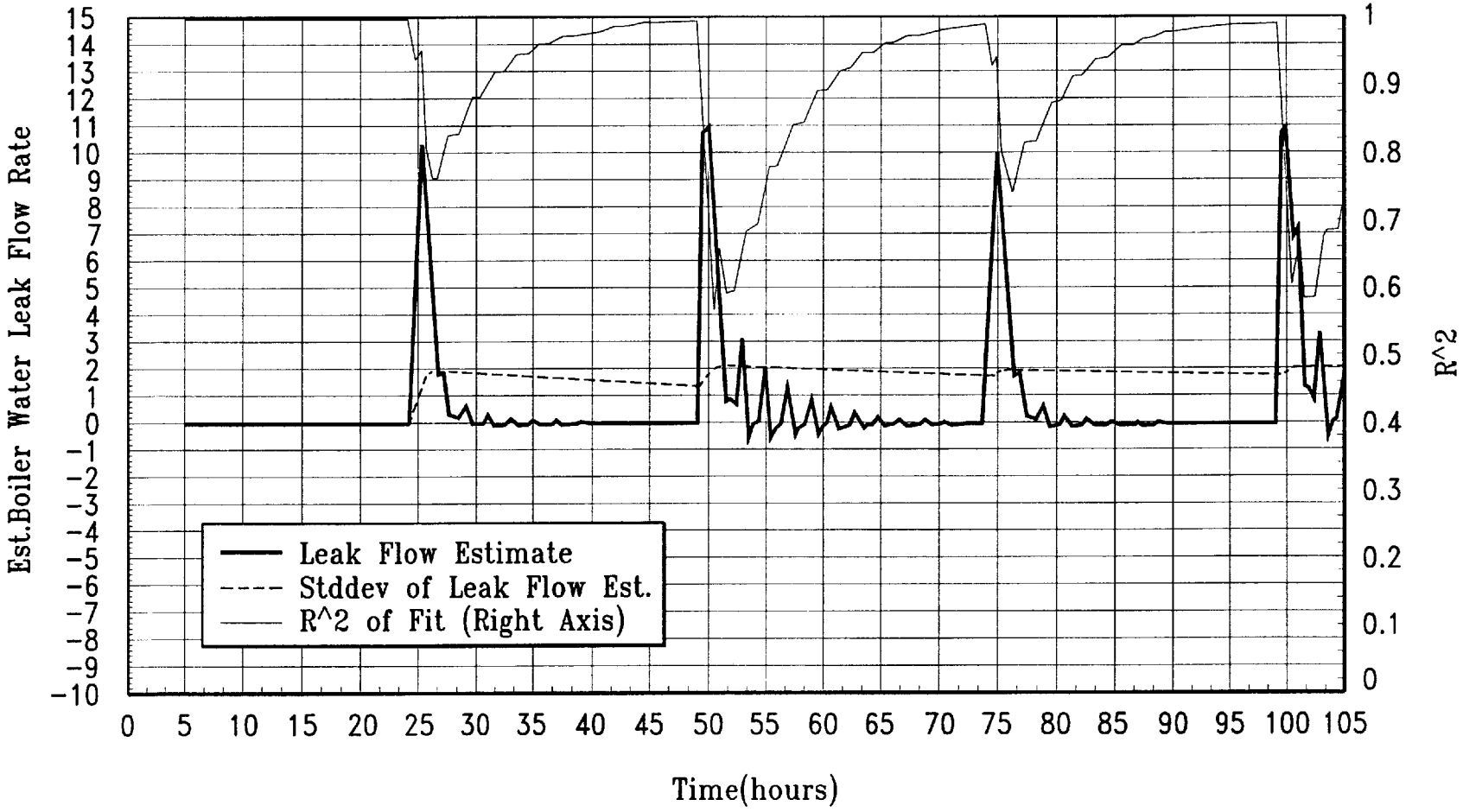
FIG. 7 is the mathematical leak model of FIG. 6 after an automatic outlier removal method has been applied.

It should be noted how the perfect fit is restored after the problematical data near the periods of model mismatch is expunged from the filter. This ability to excise data from the filter is important. Its most direct application is during periods when the data being fed to the filter is clearly meaningless, such as when the boiler system is down for repairs. Another example is a system with relatively frequent leaks: if such data were not discarded from the data during periods where it is known that leaks were ongoing after detecting them, the data from such periods would tend to unnecessarily inflate the estimated standard deviation. Since the goal is to see if the current leak flow estimates are large in comparison to periods when there were no leaks, the estimated standard deviation should be based only on leak-free periods. In some cases, manual data excision is the only practical option. For example, the decision as to if a particularly large value of a leak statistic should be interpreted as a leak (and excised) or interpreted as normal statistical variation (and included in the reference statistics) can only be made with the aid of additional information (e.g., was there really a leak after all?). However, for the routine unusual data sequence, REWLS software also provides a method of automatically existing data points based on the rate at which they decrease the R^2 (the degradation heuristic, see below) of the fit. If adding a data point to the fit results in a value of d(R^2)/dt less than a user specified threshold, that data point is viewed at "too inconsistent with the model to be credible" and is ignored). Automatic outlier removal is particularly useful in eliminating the occasional, short, wild data point sequence. The graph in FIG. 7 shows the result of running the model with a Min d(R^2)/dt of −0.4/hr. As can be seen in FIG. 7, although the impact of the model mismatch is not totally eliminated as it is with manual excision, by removing those points where R^2 is dropping most quickly due to steaming rate changes, the impact of data from periods in which the model apparently does not apply very well is minimized. Thus, the filter is more robust relative to short periods of model mismatch.

Average, Standard Deviation, of Fitted Parameters; Significance Tests

The REWLS software computes the EWMA and Exponentially Weighted Standard Deviation (EWSD) of the fitted parameters over a time window, called "a Tau", which can be specified separately for each fitted vector.

For the EWSD, the REWLS software uses the formula:

$$EWSD(a_i) = \sqrt{EWMA(a_i^2) - (EWMA(a_i))^2}$$

This equation for the EWSD is the exponentially weighted analog of a similar, well known, equation for determining standard deviation via computing the average of the squared $x_i$'s and the average of the $x_i$'s, squared. These statistics provide a summary of how the fitted parameters have moved around in the past; they can be used as a basis core determining if the current value of the fitted parameter is unusually large, or if it differs from zero.

It is important that time windows used, i.e., the value of "a Tau", involve sufficient data to capture a "representative sample" of the variation of the fitted parameters. At a minimum, these windows should be at least five times the size of the largest Tau of any fitted parameter of the model, since this is needed to provide five non-overlapping, arguably independent, data sets as a basis for the estimates of $a_i$ variability. However, in most applications one wants to make the "a Tau" much larger than this, since in most cases the relevant question in evaluating these statistics is "is this value of the fitted parameter unusual given the values seen over the last year" rather than "is the value unusual relative to the values seen over the last week". This is true, unless there is a good reason for assuming that the variability of the fitted parameter itself changes over time, and thus that using historical data that goes back for a year does not provide a good basis for detecting "unusually large" variability. In addition, another reason for using a very large time window for a Tau is that after the initial startup period, the large time window tends to make the average and standard deviation statistics immune to the (much shorter) periods of missing data that are likely to arise in practice.

Note that although the standard deviation can be a useful statistic for characterizing the overall "spread" of data even when the distribution of the data is non-normal, such hypothesis tests are only valid when the data is distributed normally.

Significance Testing in REWLS With Multiple Hypothesized Leak Growth Rates (Tau's)

As discussed above, it has been described how to make significance tests for models in which a specific leak growth rate is hypothesized in advance; and also the importance of using several different models, each with a different hypothesized leak growth rate. However, two key questions for the actual practice of the invention when more than one such leak growth rate is hypothesized have not been addressed previously:

1. Given that, for practical reasons, the maximum number, N, of distinct leak $Tau_i$'s is limited, how to choose the specific sequence of $Tau_i$'s to use?
2. How to combine the individual tests of significance corresponding to each of these $Tau_i$'s into a single, overall, test of significance to answer the question "has a leak, regardless of growth rate, occurred?"

With regard to question #1, it is assumed that it is possible to define, in advance, a range of leak growth rates that are of interest. That is, the leaks to be detected are those leaks with growth rates associated with Tau's in the range $Tau_{min}$ <=Tau <=$Tau_{max}$. thus, question #1 becomes: how many $Tau_i$'s within this range should be used, and how should they be spaced?

To answer this question, it is assumed that a "true exponential leak event" with characteristic time Tau has been fit to that discrete leak shape (with characteristic time $Tau_i$= Tau+dTau) which, from among the N available, most closely approximates the true leak event in a least squares sense. Thus, the original leak shape can be written as the sum of a multiple of the discrete leak shape plus a vector of residuals:

$$\langle \exp(-(t\text{Current}-t)/\text{Tau})\rangle = a^* \langle \exp(-(t\text{Current}-t)/(\text{Tau}+d\text{Tau}))\rangle + \langle R(t)\rangle, \text{ (for } t<=t\text{Current and } d\text{Tau}>-\text{Tau})$$

If "a" is selected via a least squares fit, the vector <R(t)> represents that component of the original, "pure exponentially shaped leak" vector that, because of truncation error associated with the use of a finite number of $Tau_i$'s, will become part of the noise, rather than part of the leak related signal. For example, if dTau is 0, <R(t)> will be 0, whereas as dTau approaches , <R(t)> will approach the original vector, <exp(−(tCurrent−t)/Tau)>. The goal is to determine both the number and spacing of the $Tau_i$'s that will result in a reasonable balance between the competing goals of minimizing the computational cost (the number of $Tau_i$'s whose associated exponential shapes must be fitted) and minimization of truncation related errors (the fraction of the total sum of squares due to <R(t)> above).

Before estimating the fraction of the sum of squares associated with truncation error, it should be noted that the whole premise of this method is that any leak can be approximated, to first order, by an exponential leak shape with some, single, Tau. Even if an unlimited number of $Tau_i$'s were available, this premise itself would introduce "leak shape mismatch related errors" which would depend upon the actual way the specific leak in question evolved over time. Thus, a reasonable rule of thumb to be employed is that an acceptably small level of truncation error is one that is much less than the size of the unavoidable error associated with approximating a step-shaped leak with an exponential. Basically, the argument is that it makes no sense to expend extra computational resources eliminating truncation related forms of leak model mismatch as long as larger, unavoidable, forms of leak model mismatch, associated with the exponential leak shape heuristic, still remain. The degree to which a step-shaped leak can be approximated by an exponentially shaped leak with an appropriately chosen growth rate is also of interest in and of itself, because, intuitively, a step seems to be that leak shape that, of all possible leak shapes that increase or remain the same as time goes on, would be hardest for an exponential to approximate well. Thus, an additional reason for considering how well a step can be approximated by an exponential is that it permits an estimate to be made of an upper bound on the information loss associated with the exponential leak shape heuristic when applied to real world leaks which do not grow exponentially.

Approximating a Step Function with an Exponential

Assume that a step leak, beginning at time tCurrent−stepDuration, and continuing to the current time, tCurrent, is fitted to an exponential leak shape with characteristic time Tau:

$$\langle \mathrm{Step}(t, t\mathrm{Current}-\mathrm{stepDuration})\rangle = a^{*}\langle \exp(-(t\mathrm{Current}-t)/\mathrm{Tau})\rangle + \langle R(t)\rangle$$

Here, Step(x, y) is defined as 0.0 if x<y and 1.0 if x>=y. Then, dotting both sides by <exp(−(tCurrent−t)/Tau)> and exploiting the fact that <R(t)> will be orthogonal to <exp(−(tCurrent−t)/Tau)> for a least squares fit, the constant, "a", which brings the given exponential shape closest to the step in a least squares sense is:

$$a = \langle \mathrm{Step}(t, t\mathrm{Current}-\mathrm{stepDuration})\rangle \cdot \langle \exp(-(t\mathrm{Current}-t)/\mathrm{Tau})\rangle / (\langle \exp(-(t\mathrm{Current}-t)/\mathrm{Tau})\rangle \cdot \langle \exp(-(t\mathrm{Current}-t)/\mathrm{Tau})\rangle)$$

Applying the fact that:

$$\langle \mathrm{Step}(t, t\mathrm{Current}-\mathrm{stepDuration})\rangle \cdot \langle \exp(-(t\mathrm{Current}-t)/\mathrm{Tau})\rangle = \mathrm{Tau}^{*}(1-\exp(-\mathrm{stepDuration}/\mathrm{Tau}))$$

and that:

$$\langle \exp(-(t\mathrm{Current}-t)/\mathrm{Tau})\rangle \cdot \langle \exp(-(t\mathrm{Current}-t)/\mathrm{Tau})\rangle = \mathrm{Tau}/2$$

Both of which follow directly from the definition of dot products between such vectors as integrals), the following is obtained:

$$a = 2^{*}(1-\exp(-\mathrm{stepDuration}/\mathrm{Tau})))$$

Therefore, the fraction of the total sum of squares associated with model mismatch is one minus the fraction of the step's sum of squares associated with the exponential, or:

$$\mathrm{ModelMismatchFractionOfSumOfSquares} = 1 - a^{a}{}^{*}\langle \exp(-(t\mathrm{Current}-t)/\mathrm{Tau})\rangle \cdot \langle \exp(-(t\mathrm{Current}-t)/\mathrm{Tau})\rangle / (\langle \mathrm{Step}(t, t\mathrm{Current}-\mathrm{stepDuration})\rangle \cdot \langle \mathrm{Step}(t, t\mathrm{Current}-\mathrm{stepDuration})\rangle) = 1 - 2^{*}(1-\exp(-\mathrm{stepDuration}/\mathrm{Tau}))^{2}{}^{*}(\mathrm{Tau}/\mathrm{stepDuration})$$

The $\mathrm{Tau}_i$ that would minimize this model mismatch fraction would be the ideal. This ideal Tau can be determined by differentiating this model mismatch fraction with respect to Tau, and then setting the result to 0. By doing this, it can be shown that:

$$2^{*}\mathrm{stepDuration}/\mathrm{Tau}+1 = \exp(\mathrm{stepDuration}/\mathrm{Tau})$$

By letting x=stepDuration/Tau and solving the transcendental duration of the form "2*x+1=exp(x)", for x>0, there is only one solution, x=1.2564 (found numerically). This implies that Tau=stepDuration/1.2564 is the best fitting exponential shape for a square step of a given duration. Plugging this result into the original equation results in the fraction of the sum of squares associated with model mismatch due to the approximation of a step with an (ideally selected) exponential shape:

$$\mathrm{ModelMismatchFractionOfSumOfSquares}\ (\text{using the best fitting Tau}) = 1 - 2^{*}(1-\exp(-1.2564))^{2}/1.2562 = 0.185$$

Thus, if a step is approximated with an exponential, a substantial fraction of the sum of squares (18.5%) for the step will appear as noise, even if the Tau is optimally chosen so as to fit a step of exactly this duration as well as possible. In the next section, this fact is used to justify the particular choice of $\mathrm{Tau}_i$'s.

On the other hand, this result also shows that, even for a shape as different as a step is from an exponential, an exponentially shaped leak model can, with the proper choice of Tau, produce models that account for over 80% of the total sum of squares associated with the leak event. This confirms the "the exponential leak shape heuristic" which affirms that a single, appropriately chosen exponentially shaped leak model can capture most of the leak induced variation in just about any leak event that involves leak flows that increase, or remain the same, over time.

Determining How to Choose the $\mathrm{Tau}_i$'s To Obtain Acceptably Small Truncation Error The original problem was to determine the fraction of the sum of squares associated with a pure, exponentially shaped, leak with characteristic time Tau that would appear as noise if this leak were fitted to the "closest" $\mathrm{Tau}_i$=Tau+dTau that was available. To this end, the original leak shape was expressed as the sum of a multiple of the discrete leak shape plus a vector of residuals:

$$\langle \exp(-(t\mathrm{Current}-t)/\mathrm{Tau})\rangle = a^{*}\langle \exp(-(t\mathrm{Current}-t)/(\mathrm{Tau}+d\mathrm{Tau}))\rangle + \langle R(t)\rangle$$

After performing a least squares fit to determine the constant, "a", such that the sum of the squared residuals, <R(t)>·<R(t)>, is as small as possible, the fraction of the sum of squares associated with the left hand side functional vector, <exp(−(tCurrent−t)/Tau)>,that can be accounted for by using a multiple of the right hand side function vector, <exp(−(tCurrent−t)/(Tau+dTau))>, provides an estimate of how well an exponential shape using a time constant of $\mathrm{Tau}_i$=Tau+dTau can approximate a leak event that is exactly of the form given by an exponential shape with a time constant of Tau.

As before, if the parameter, "a", is determined via least squares fitting, the residual vector, <R(t)>, will be orthogonal to <exp(−(tCurrent−t)/(Tau+dTau))>. Hence, after dotting both sides by <exp(−(tCurrent−t)/(Tau+dTau))> the best fitting "a" can be obtained:

$$a = (\langle \exp(-(t\mathrm{Current}-t)/\mathrm{Tau})\rangle \cdot \langle \exp(-(t\mathrm{Current}-t)/(\mathrm{Tau}+d\mathrm{Tau}))\rangle / \langle \exp(-(t\mathrm{Current}-t)/(\mathrm{Tau}+d\mathrm{Tau}))\rangle \cdot \langle \exp(-(t\mathrm{Current}-t)/(\mathrm{Tau}+d\mathrm{Tau}))\rangle)$$

Thus, the fraction of the total sum of squares of the original exponential vector, <exp(−(tCurrent−t)/Tau)>, that can be "accounted for" by the discrete exponential vector, <exp(−(tCurrent−t)/(Tau+dTau))> is:

$$\text{ModelFractionOfSumOfSquares} = a^2 * \langle \exp(-(t\text{Current}-t)/(\text{Tau}+d\text{Tau}))\rangle \cdot \langle \exp(-(t\text{Current}-t)/(\text{Tau}+d\text{Tau}))\rangle / \langle \exp(-(t\text{Current}-t)/\text{Tau})\rangle \cdot \langle \exp(-(t\text{Current}-t)/\text{Tau})\rangle) = (\langle \exp(-(t\text{Current}-t)/\text{Tau})\rangle \cdot \langle \exp(-(t\text{Current}-t)/(\text{Tau}+d\text{Tau}))\rangle)^2 / ((\langle \exp(-(t\text{Current}-t)/(\text{Tau}+d\text{Tau}))\rangle \cdot \langle \exp(-(t\text{Current}-t)/(\text{Tau}+d\text{Tau}))\rangle) * (\langle \exp(-(t\text{Current}-t)/\text{Tau})\rangle \cdot \langle \exp(-(t\text{Current}-t)/\text{Tau})\rangle))$$

It can be shown, based on the definition of dot products, that the above equation reduces to:

$$\text{ModelFractionOfSumOfSquares} = 4*(1+d\text{Tau}/\text{Tau})/(2+d\text{Tau}/\text{Tau})^2$$

Since the fraction of the sum of squares associated with truncation induced leak model mismatch is 1 minus the fraction associated with the discrete exponentially shaped leak model, then:

$$\text{TruncationFractionOfSumOfSquares} = 1 - \text{ModelFractionOfSumOfSquares} = (d\text{Tau})/(2*\text{Tau}+d\text{Taul}))^2$$

The purpose of the above is to obtain a sequence of $\text{Tau}_i$'s such that any real world leaks with growth rates in the range of interest (i.e. $\text{Tau}_{min} < \text{Tau}_{Leak} < \text{Tau}_{max}$) can be reasonably well approximated by one of the $\text{Tau}_i$'s in the sequence. Specifically, $\text{Tau}_i$'s are sought such that the above TruncationFractionOfSumOfSquares is small in comparison to the ModelMismatchFractionOfSumOfSquares (an upper bound on which was previously estimated as 0.185).

Therefore, a good way to choose the spacing of the $\text{Tau}_i$'s is to space them so that, for a fixed N, the largest TruncationFractionOfSumOfSquares that can occur (using exponentially shaped leaks with Tau's in the given range) is minimized. Although a fully optimal spacing would not include the endpoints $\text{Tau}_{min}$ and $\text{Tau}_{max}$, to simplify the discussion and the form of the resulting equation, the following constraints are added: $\text{Tau}_l * \text{Tau}_{i+l})^{1/2}$ for some i. Substituting this expression into the expression for TruncationFractionOfSumOfSquares yields:

$$\text{TruncationFractionOfSumOfSquares (largest between Tau}_i \text{ and Tau}_{i+l}) = ((1-(\text{Tau}_{i+l}/\text{Tau}_i)^{1/2})/(1+(\text{Tau}_{i+l}/\text{Tau}_i)^{1/2}))^2$$

One can verify that the geometric mean is, indeed, the worst case by noting that the above expression can be written as:

$$\text{TruncationFractionOfSumOfSquares (largest between Tau}_i^{1/2} - \text{Tau}_{i+l}^{1/2}) = ((\text{Tau}_i^{1/2} - \text{Tau}_{i+l}^{1/2})/(\text{Tau}_i^{1/2} + \text{Tau}_{i+l}^{1/2}))^2$$

This expression has the same value if $\text{Tau}_i$ and $\text{Tau}_{i+l}$ are interchanged; such an interchange corresponds to computing TruncationFractionOfSumOfSquares where dTau is computed as the distance to $\text{Tau}_{i+l}$, rather than as the distance to $\text{Tau}_i$, computed above. Thus the geometric mean is the balance point at which the truncation error involved by approximating leaks of this size using either the $\text{Tau}_i$ or $\text{Tau}_{i+l}$ is the same, and therefore it has the maximum truncation error.

Since this function depends only on the ratio of successive $\text{Tau}_i$'s, it follows that the largest possible truncation error can be minimized if the $\text{Tau}_i$'s are spaced such that the ratio of successive $\text{Tau}_i$'s is a constant, C:

$$\text{Tau}_{i+l} = C * \text{Tau}_i$$

As stated above for simplicity, the endpoints were fixed via $\text{Tau}_l = \text{Tau}_{min}$ and $\text{Tau}_{max} = \text{Tau}_N$; repeated application of the above recursion yields:

$$\text{Tau}_i = \text{Tau}_{min} * C^{i-l} \text{ and } \text{Tau}_{max} = \text{Tau}_N = \text{Tau}_{min} * C^{N-l}.$$

Hence, $C = (\text{Tau}_{max}/\text{Tau}_{min})^{l/(N-l)}$. Basically, the three parameters:

$$C = \text{Tau}_{i+l}/\text{Tau}_i$$

(or, equivalently, TruncationFractionOfSumOfSquares), $\text{Tau}_{max}/\text{Tau}_{min}$, and N are interdependent. If any two are chosen, then the above equation can be solved to determine the third. However, for simplicity, a sequence of $\text{Tau}_i$'s is recommended such that C=2, and where:

$$\text{Tau}_i = 2^{(i-1)} \cdot \text{Tau}_{min} \quad i=1,2, \ldots N \text{ and } \text{Tau}_{max} = 2^{N-1} * \text{Tau}_{min}$$

The TruncationFractionOfSumOfSquares obtained via the above equation using $C = \text{Tau}_{i+l}/\text{Tau}_i = 2$ is 0.029, which is much less than 0.185, the fraction of the sum of squares due to leak shape mismatch computed in the previous section. Thus, the worst case truncation related sum of squares is still quite small in comparison to the worst case shape mismatch sum of squares (due to a step shaped leak), and thus it is justified to use this "powers of 2" grid of $\text{Tau}_i$'s. For example, the sequence of $\text{Tau}_i$'s given by: 1, 2, 4, 8, and 16, hours is appropriate for estimating leak flows with growth rates associated with Tau's between 0.707 $(=(\frac{1}{2}*1)^{1/2})$ and 22.6 $(=(16*32)^{1/2})$ hours with a truncation related fraction of the sum of squares of no more than 0.029.

Significance Testing

With the above choice of Tau's, it is assured that a relatively small number of exponential shapes can be used to attain reasonable approxmiations to any one of a broad class of models represented by a single exponential shape with a Tau within a certain range. Since this provides N statistics, one might simply perform N separate significance tests and declare a leak if any of these values were statistically significant. Although this would seem (and in certain cases may indeed even be) sensible, the problem is that, because repeated tests on N different hypotheses are being conducted, rather than of a single hypothesis, the probability of getting any one of these N statistics to be significant at the "two sigma" level is higher than it would have been if only a single test were conducted. For example, if N were 100, and each test were independent of the others then it would not be unusual at all to obtain one of the statistics to be unusual a the 99% confidence level, because, by definition, on average, exactly one of the individuals per hundred will be declared unusual at the 99% confidence level when each individual is sampled independently of the others.

If the 1 hour leak estimate is not statistically significant at a certain confidence level, then, since the 1 hour and 2 hour leak shapes have a rather high degree of linear dependence (as determined in the previous section), these two statistics are not independent of each other. As such, although there is a greater probability that either the 1 hour leak flow estimate or the 2 hour leak flow estimate will be statistically significant at a given confidence level than just the 1 hour leak flow being significant at the same confidence level, this increase in probability is nowhere near what it would have been if the two leak flow estimates had been independent of each other.

Determining exactly how much the significance tests have to be adjusted to account for this dependence may be solvable analytically in the special case in which the inputs to the REWLS model consist of white noise plus leaks. But the nature of REWLS fitting makes this assumption unlikely, at least in the general case (even if the noise on the raw data is normally and independently distributed (NID), the effect of fitting a REWLS model to this data is similar to passing the data through a linear filter, and in general the resulting sequence will therefore no longer be independent).

To overcome this problem, a statistic is defined that combines the various leak flow estimates into an overall measure of the "degree of unusualness from a leak flow perspective". Next, the distribution (e.g., average and standard deviation) of this new statistic is empirically determined. The hypothesis testing is then based directly on the values of this statistic in comparison to its empirically determined distribution.

Such a statistic is formed by standardizing each of the leak flow estimates (by subtracting its long-term leak free average and dividing by its long-term leak free standard deviation) and then choosing the largest of these standardized values, at each point in time, as the "measure of overall unusualness from a leak flow perspective". With such standardization, any of the leak flow estimates will be equally unusual at their corresponding two sigma levels regardless of the use of, e.g., a 1, 2, 4, 8, or 16 hour Tau leak shape.

The statistical test is as follows: The null hypothesis is that no leak is in progress while the alternative hypothesis is that an exponentially shaped leak of some single, but unknown growth rate, characterized by $Tau_{Leak}$, where $Tau_{min}<=Tau_{Leak}<=Tau_{max}$, is currently in progress. As per the truncation error limitation strategy discussed above, there are N $Tau_i$'s for which an estimated leak flow is available, one of which will provide a reasonable approximation of what would have been obtained had an exponential shape with exactly the right $Tau_{Leak}$ been used. The question then becomes: which of these $Tau_i$'s should be selected as the one most likely to have been associated with the hypothesized real, exponentially shaped, leak?.

A reasonable answer to this question is to choose that $Tau_i$ such that the estimated leak flow associated with that $Tau_i$ has the highest probability of being associated with a real leak event (and hence the lowest chance of being caused by ordinary statistical fluctuations). That is, select $Tau_i$ such that the associated significance level of the corresponding estimated leak flow is maximized, i.e., such that the standardized leak flow estimate is largest. This $Tau_{iLeak}$ is known as the maximum likelihood leak Tau, and the standardized leak flow rate for this Tau is known as the maximum likelihood standardized leak flow rate (MLSLF). These maximum likelihood standardized leak flow rates will themselves have a distribution, determined empirically by estimating the MLSLF's for times at which no leak is in progress, and the significance level of any particular MLSLF obtained thereafter can be determined by comparing it against this distribution (e.g., as characterized by an average and standard deviation) in the ordinary manner.

Specifically, the maximum likelihood standardized leak flow (MLSLF) is defined as:

$$\text{MLSLF}=\text{Maximum over } i=1, 2, \ldots N\{(a(Tau_i)-\text{aLeakFreeAverage}Tau_i))/\text{aLeakFreeStandardDeviation}(Tau_i)\}.$$

Here "$a(Tau_i)$" is the current leak flow estimate for the model that has a leak Tau of $Tau_i$, and "aLeakFreeAverage ($Tau_i$)" is the average value of this estimated leak flow, and "aLeakFreeStandardDeviation($Tau_i$)" is the estimated standard deviation of this leak flow, both computed during leak free periods.

This MLSLF will itself have a distribution (e.g., as characterized by a standard deviation and average), known as the standardized maximum likelihood standardized leak flow, SMLSLF, which can also be computed empirically by using data from leak free periods. The statistical significance of the MLSLF during periods in which a leak may be in progress can then be determined using this SMLSLF. Thus, the SMLSLF represents the single leak detection signal that can detect both slow-growing and fast-growing leaks and can be easily interpreted by boiler operators.

It should be noted that generation of the MLSLF statistic can be accomplished in the computer-based control unit 30 by standardizing the leak flow estimates and computing the maximum of all of these standardized leak flow estimates (see previous equation: MLSLF=Maximum over I=1, 2, . . . N, etc.), and all of the inputs to this equation are currently provided by the REWLS software. The MLSLFs so computed can then be fed back into another REWLS model for the purpose of averaging them and determining the SMLSLF.

Advantages Over Use Of A Single Exponential Leak Shape

The above process can be viewed as one in which the unknown leak growth rate is "fit" to the data. The advantage of determining the "best fitting" exponential shape in this manner, rather than using just a single exponential shape, is that the system 20 remains sensitive to statistically significant changes in mass balance regardless of if they occur quickly or accumulate over long periods of time. And all this is done with very little computational effort, due to exploitation of the facts that: 1) exponential shapes provide reasonably good approximations to any, monotonically increasing, leak event and 2) exponential shapes over a rather broad range of Tau's can be well approximated, in a least squares sense, by a sequence of $Tau_i$'s whose successive elements increase exponentially (e.g., as powers of 2).

Example 3: SMLSLF with Five EWMA Fits

Figure 8:
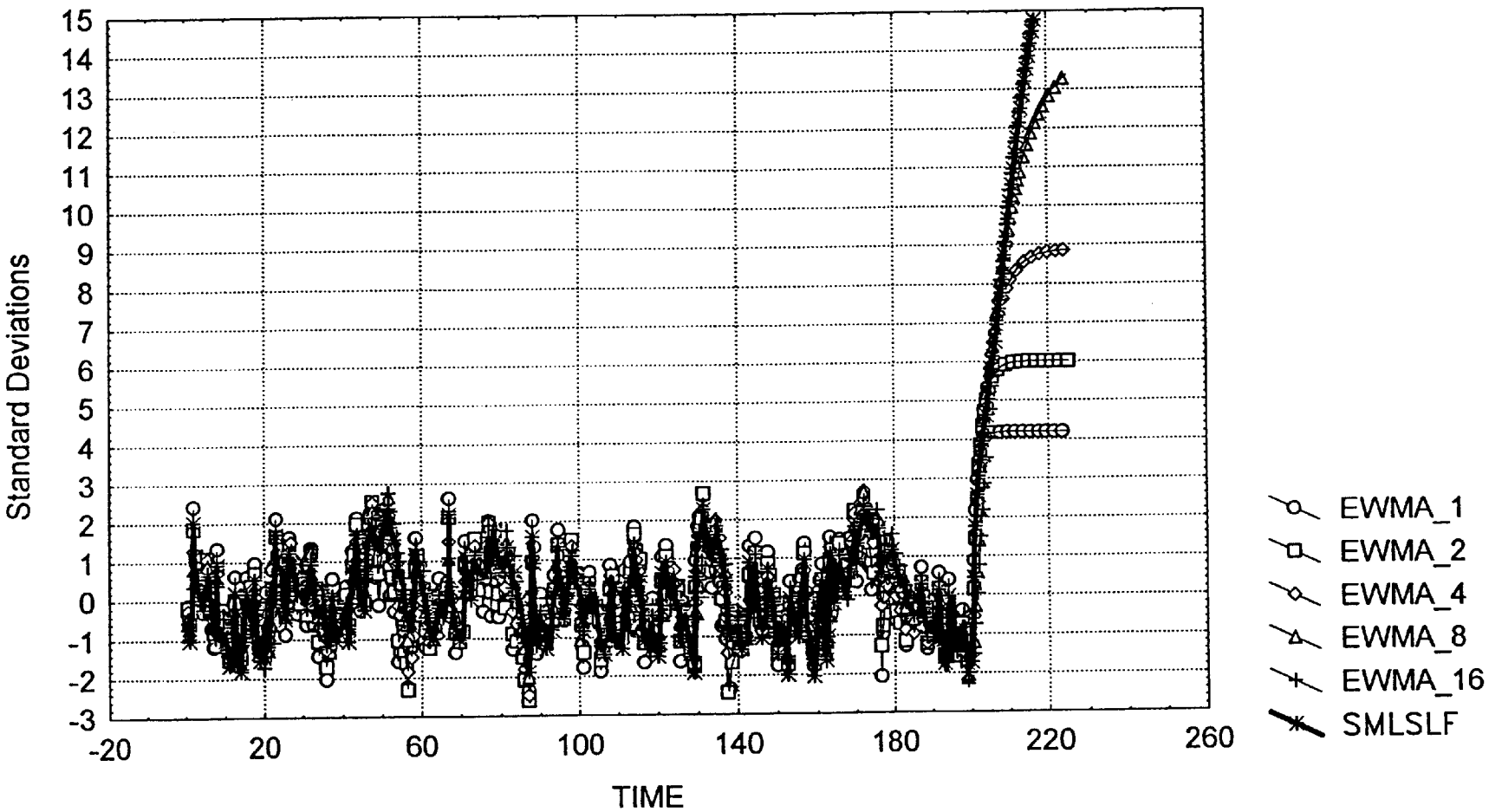
FIG. 8 is a response of maximum likelihood standardized leak flow (MLSLF) to a step leak in comparison to the responses of the EWMAs on which it is based.

FIG. 8 depicts an example of these advantages. This graph shows the standardized MLSLF along with the five EWMA's, also standardized, upon which it is based (recall that an EWMA is the simplest REWLS model). Because all values are standardized, the values on the graph can be interpreted as a measure of the signal to noise ratio (information content/quality) of each of these indicators. Up until hour 200, the original sequence consists of a unit normal distribution; thereafter, a step shaped leak, of size 2, is introduced. Both the SMLSLF and EWMA's have been standardized using the averages and standard deviations computed during the leak free period (t<=200). To show the actual response of each curved to the step more clearly, the simulated noise was turned off at the point at which the step shaped leak was introduced. The period immediately after the leak is of the most interest; the first 16 hours after the leak begins are shown in more detail in FIG. 9.

Figure 9:
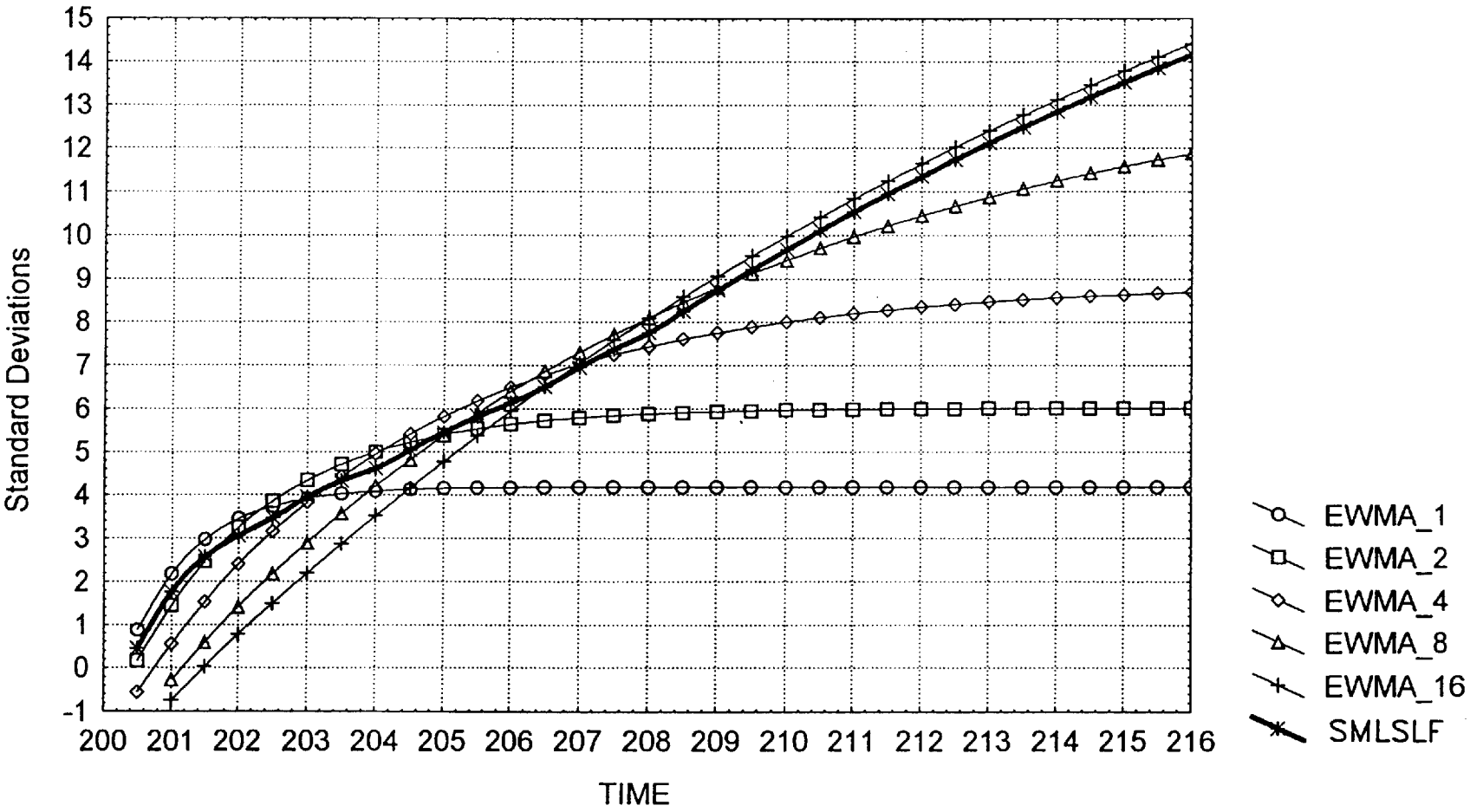
FIG. 9 depicts the graph of FIG. 8 but in more detail for the first 16 hours after the step.

The graph in FIG. 9 demonstrates how the SMLSLF tracks the most statistically significant of the EWMA's, thus (for example) outperforming the 16 hour EWMA during the firts five hours of the leak and outperforming the 1 hour EWMA thereafter. Note how this graph seems to confirm that spacing $Tau_i$'s multiples of the powers of 2 does not result in appreciable truncation error: if only the 1 and 16 hour EWMA had been used, the larger of these two significance levels would have formed a curve that would have looked only a little worse than the curve actually obtained with the more detailed "grid" of $Tau_i$'s.

The most significant of the individual tests should always be more significant than the SMLSLF because the act of determining which $Tau_i$ to use introduces another potential source of variability into the SMLSLF statistic that each individual statistic, with its apriori choice, avoids. This seems to be confirmed by the graph in FIG. 9, since the SMLSLF is always a little below the particular EWMA it tracks. Indeed, the reason why the SMLSLF itself needs to be standardized is to determine this difference.

Figure 10:
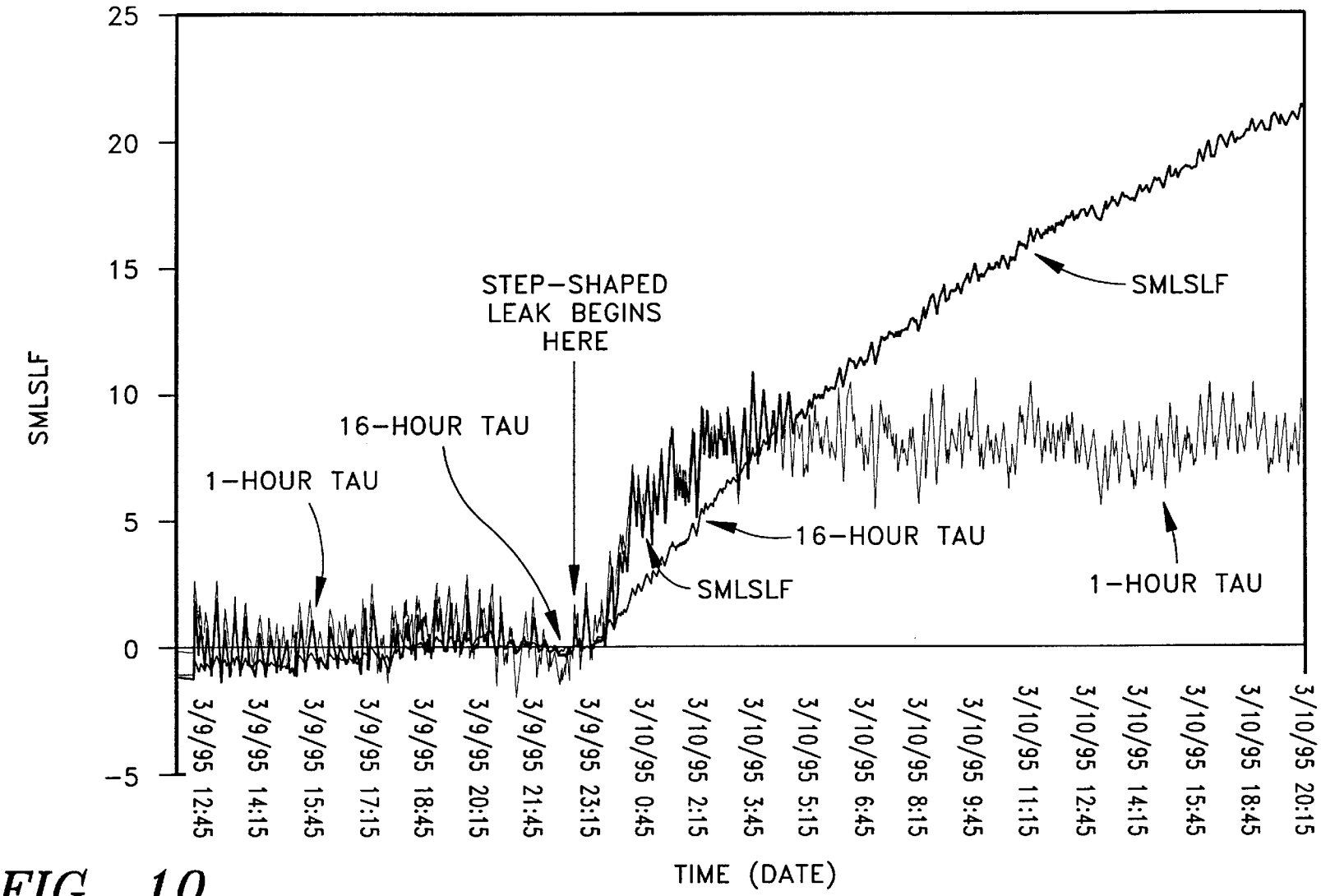
FIG. 10 depicts a standardized maximum likelihood standardized leak flow (SMLSLF) using real process noise assuming a step-shaped leak and using a 1-hour tau exponentially-weighted moving average (EWMA) and a 16-hour EWMA.

FIG. 10 depicts a SMLSLF determined using real boiler water mass balance process noise assuming a step-shaped leak and using a 1-hour tau EWMA and a 16-hour tau EWMA (i.e., $Tau_{min}$=1, N=2 and C=16).

Computing the MLSLF And Determining Its Significance When the Noise Sequence is Normally and Independently Distribution The previously described computation of the Maximum Likelihood Standardized Leak Flow (MLSLF) required that the standard deviation and average of each of the estimated leak flows, as well as the distribution of the MLSLF itself be determined empirically, by applying the MLSLF calculation directly to the known-to-have-been leak free data. When the noise sequence is known to be normally and independently distributed (NID), and when the process model component of the measured vector of flow imbalances varies independently of the leak and noise model components, it is possible to considerably simplify these preliminary MLSLF calculations, as described below.

Note that, although the assumption of NID noise is often made, the assumption is often invalid with process noise sequences, which tend to be serially correlated. However, as discussed later in this application, REWLS models are invariant under a class of linear transformations known as ARIMA models, which are capable of transforming most serially dependent process noise sequences into white noise. Since the methods discussed in this section are directly applicable to the resulting "ARIMA pre-whitened" noise sequences, they have much broader applicability then might be otherwise suspected.

First, rather than determining the standard deviation of each leak flow estimate empirically, these standard deviations can be determined analytically, via a propagation of errors calculation. Recall that, under the assumed independence alluded to above, the fitted leak estimates, a, will be, apart from a fixed factor of two which has no impact on the normalized SMLSLF statistic, the same as the EWMA's of the noise sequence that results from subtraction of the process model from the original flow imbalances. In what follows, "EWMA" is used rather than "fitted leak estimates" to emphasize the relationship to the propagation of errors calculation for an EWMA, which is well-known. Thus, each of the least squares fitted leak flows of the SMLSLF is replaced with its the corresponding EWMA, and the original formula for the MLSLF becomes:

$$\text{MLSLF}=\text{Maximum over } i=1, 2, \ldots N\{(\text{EWMA}(\text{Tau}_i)-0)/\text{StdDev}(\text{EWMA}(\text{Tau}_i))\}$$

Here, using the fact that if the noise sequence is NID with mean 0, all of the EWMA's will have long-term averages of 0 as well. If the long term average of the noise sequence is non-zero, it should be subtracted from all of the EWMA's—which essentially makes it part of the process model.

The EWMA is defined as:

$$\text{EWMA}(t_i)=(1=-\exp(-\text{dt}/\text{Tau}_i))*\text{Sum } i=0 \text{ to}-\text{infinity}\{\exp(i*\text{dt}/\text{Tau}_i)*\text{NIDNoise}(t_i)\}$$

At this point, it is assumed that $\text{NIDNoise}(t_i)$ represents a good characterization of the measured flow imbalances not captured by the process model.

The variance of $\text{EWMA}(t_i)$ during leak free periods can be computed by squaring it, and computing the "expected value" (average over many realizations of the NID distribution) in the ordinary manner:

$$\text{EWMA}(t_i)^2=(1-\exp(-\text{dt}/\text{Tau}))^2*(\text{Sum } i=0 \text{ to } -\text{infinity}\{\exp(i*\text{dt}/\text{Tau})^2*\text{NIDNoise}(t_i)^2\}+\text{"Cross Terms"}$$

$$=(1-\exp(-\text{dt}/\text{Tau}))^2*(\text{Sum } i=0 \text{ to } -\text{infinity}\{\exp(\text{dt}/\text{Tau})^{(2*i)}*\text{NIDNoise}(t_i)^2\}+\text{"Cross Terms"}$$

Here "Cross Terms" are all of the terms involving products of the form $\text{NIDNoise}(t_i)*\text{NIDNoise}(t_j)$ with i !=j.

Since, by assumption, the noise sequence is NID and hence not correlated, the expected value of such cross product terms will be always zero. The expected value of each $\text{NIDNoise}(t_i)^2$ is $\text{NIDStdDev}^2$, the variance of the variance). Recognizing that the infinite sum in the above expression is a geometric series of the form:

$$1/(1-x)=1+x+x^2+\ldots$$

with $x=\exp(-\text{dt}/\text{Tau})^2$, the well known result for the variance of an EWMA of independent, unit normal deviates (see Hunter) is obtained:

$$\text{Variance}(\text{EWMA}(t_i))=(1-\exp(-\text{dt}/\text{Tau}))^2*\text{NIDStdDev}^2/(1-\exp(-\text{dt}/\text{Tau})^2)=(1-\exp(-\text{dt}/\text{Tau}))*\text{NIDStdDev}^2/(1+\exp(-\text{dt}/\text{Tau}))$$

Here NIDStdDev is the standard deviation of the NID noise sequence, to be determined using data collected during leak free periods.

Thus, taking the square root:

$$\text{StdDev}(\text{EWMA}(t_i))=((1-\exp(-\text{dt}/\text{Tau}))/(1+\exp(-\text{dt}/\text{Tau})))^{1/2}*\text{NIDStdDev}$$

As a check, note that, as Tau increases towards infinity, the standard deviation decreases towards 0, since the EWMA averages together ever greater numbers of normal deviates. On the other hand, as Tau goes towards 0, since the EWMA picks off only the most recent point, the standard deviation of the EWMA approaches the standard deviation of a single point, and therefore approaches NIDStdDev, as required.

Substituting these results into the formula for the MLSLF given above, yields the formula:

$$\text{MLSLF}=\text{Maximum over } i=1, 2, \ldots N\{\text{EWMA}(\text{Tau}_i)/(((1-\exp(-\text{dt}/\text{Tau}))/(1+\exp(-\text{dt}/\text{Tau})))^{1/2}*\text{NIDStdDev}))$$

Or, rearranging:

$$\text{EWMA}(t_i)^2=(1-\exp(-\text{dt}/\text{Tau}))^2*(\text{Sum } i=) \text{ to } -\text{infinity}\{\exp(i*\text{dt}/\text{Tau})^2*\text{NIDNoise}(t_i)^2\}+\text{"Cross Terms"}(\text{EWMA}(\text{Tau}_i)/\text{NIDStdDev}))*(((1+\exp(-\text{dt}/\text{Tau}))/(1-\exp(-\text{dt}/\text{Tau})))^{1/2}\}$$

NIDStdDev can be estimated by performing a least squares fit of the process model to the data during leak free periods, and determining the root mean square error of this fit. Thus, when the noise is NID, it is no longer necessary to compute each of the averages and standard deviations for each "leak Tau's" used empirically in order to compute the MLSLF.

However, determining the significance levels for this MLSLF statistic remains. Note that the MLSLF is a maximum of N statistics which are not entirely independent of each other; each of the EWMA's averages the same NID sequence, but with different weights. For example, if the one hour EWMA is unusually large, the chances are more than 50/50 that the two hour EWMA will be unusually large as well, since both EWMA's depend upon the same points in a similar manner. Unfortunately, an analytical form for this NID noise based MLSLF distribution is not known to Applicants.

However, it is possible to determine this distribution numerically, via Monte-Carlo simulations. To do this, the requisite calculations are simplified by making a few observations about the MLSLF: 1. The distribution of the MLSLF is independent of the actual size of the NIDStdDev, since each ratio that makes up the MLSLF is standardized. Therefore, it is sufficient to determine the distribution of the MLSLF for a unit NID input sequence.

2. In the preferred embodiment of the MLSLF, a finite sequence of $Tau_i$'s is employed, which are of the form Base $^{i-1}$*$Tau_{min}$ for I=1, . . . $N_{max}$, with base=2 and N=5 being given as reasonable choices. It can be shown that this form of the MLSLF depends only on $N_{max}$ and Base, but is independent of the specific $Tau_{min}$ chosen. Observation 2 can be understood as follows: by adjusting the sampling rate, the terms summed in any two EWMA's of the NID noise with different Tau's can be brought into one-to-one correspondence and hence make the two EWMA's have exactly the same weighting sequence, and hence distribution. Specifically, the adjustment required is to make $dt_2$= $dt_1$*$Tau_2$/$Tau_1$. Thus, changing $Tau_{min}$ from $Tau_{min1}$ to $Tau_{min2}$ can be viewed as equivalent to a sampling rate change that applies uniformly to all of the EWMA's and hence changes their standard deviations by the same, common, factor. Specifically, if $Tau_{min2}$>$Tau_{min1}$, this factor is approximately sqrt($Tau_{min1}$/$Tau_{min2}$), one over the square root of the factor by which the number of normal deviates fed into all of the statistics has increased. Since all of its ratio's are standardized, the introduction of such a common variance scale factor has no impact on the MLSLF. Thus, the distribution of the MLSLF is independent of $Tau_{min}$. This also shows why the MLSLF does not depend upon the sampling rate, dt, as long as dt<=$Tau_{min}$.

It should be noted that there may be a small amount of dependency if the sampling interval is not much less than $Tau_{min}$, due to truncation error; the previous argument tacitly assumes that increasing the frequency of sampling N times is roughly the same as measuring the same EWMA N times, which is only true when the amount that the exponential weights change over time dt is sufficiently small. However, this truncation error was too small to be observed in the simulations, which were run at $Tau_{min}$=1*dt and $Tau_{min}$= 32*dt.

Example 4—Expected distribution of MLSLF with NID noise

One can therefore compute the distribution of the MLSLF using a unit normal distribution as the input sequence, and with $Tau_{min}$ chosen as 1.0 * dt, via a Monte-Carlo simulation, once and for all, and then simply check the computed MLSLF against these limits, regardless of the $Tau_{min}$ and NIDStdDev used. The results of such a computation, with N and Base fixed at their suggested values of 5 and 2, are given below:

With N = 5 and Base = 2

| Confidence Level | MLSLF with Tau's of 1, 2, 4, 8, and 16 steps | Normal, one tailed | Max Bi-Normal, one tailed |
|---|---|---|---|
| 95 | 1.976 ± 0.006 | 1.645 | 1.960 |
| 99 | 2.596 ± 0.012 | 2.326 | 2.576 |
| 99.9 | 3.261 ± 0.028 | 3.090 | 3.290 |

The procedure for generating the above table was as follows. A sequence of 11,000 independent unit normal deviates was produced and EWMA's with 1, 2, 4, 8 and 16 point Tau's of these deviates were computed. The last 10,000 of these EWMA's (to eliminate "incomplete" EWMA's at the beginning) were then sorted and the values of the MLSLF appearing at points 9500, 9900, and 9990 were recorded. This process was repeated was 9 times; the table above shows the averages and the standard error on the mean for each of the three statistics so obtained. If a different number of EWMA's, or different cut-off points are desired, the simulation can be re-run to determine the new distribution with a different N. It was also observed that the cumulative MLSLF distribution is, in the tail regions likely to be of interest, reasonably well approximated by a normal distribution with a positive mean.

The table above also shows, in the third column, the one-tailed cut-off points for the ordinary unit normal distribution. As expected, since the MLSLF involves the selection of the maximum of five different, yet partially dependent, statistics, each of which is distributed as a unit normal distribution, the MLSLF cut-off points are somewhat higher than those of a single unit normal distribution.

The fourth column shows the corresponding cut-off points of a statistic defined as follows:

$$\mathrm{Max}(\mathrm{UnitNID}_1(i), \mathrm{UnitNID}_2(i))$$

That is, the maximum of two, UnitNID sequences that are completely independent of each other. These values were computed using the approximation, valid for high conference levels, that the probability of getting either of two NID sequences greater than a given value is twice that of getting one greater than that value (this slightly overestimates the probability, since it "double counts" the cases in which both sequences exceed the cutoff at the same time but, at high confidence levels, getting both UnitNID's to be significant at the same time is very rare, and therefore the error is neglibible). Thus column four is computed by showing the one tailed 97.5, 99.5, and 99.95 confidence levels for a single unit NID distribution, which, by this argument, are the same as the 95, 99, and 99.9 percent confidence levels for the maximum of two unit NID sequences.

Column four can be interpreted as follows: choosing the largest of these five statistics, which are partially dependent on each other, skews the distribution towards the plus side about as much as choosing the maximum of two statistics that are completely independent of each other. Intuitively, the five, somewhat linearly dependent, EWMA's have "around two degrees of freedom between them".

To test observation 2 above, the entire Monte-Carlo calculation was re-run using EWMA's with Tau's of 32, 64, 128, 256, and 512 points (e.g. with a $Tau_{min}$ of 32*dt). The results were, to within two standard deviations, equal to the results obtained with $Tau_i$=1, 2, 4, 8, and 16 point Tau's (e.g., with a $Tau_{min}$ of 1*dt), and therefore tend to confirm observation 2:

| Confidence Level | MLSLF with Taus of 1, 2, 4, 8, 16 | MLSLF with Tau's of 32, 64, 128, 256, 512 |
|---|---|---|
| 95 | 1.976 ± 0.006 | 1.869 ± 0.056 |
| 99 | 2.596 ± 0.012 | 2.478 ± 0.071 |
| 99.9 | 3.261 ± 0.028 | 3.173 ± 0.124 |

As expected, the errors associated with a $Tau_{min}$ of 32 are larger, because the number of independent sets of normal deviates going into the computation of the averages is smaller by a factor of 32 when the larger sequence of Tau's is used.

Together, the analytical determination of standard deviations described previously, combined with this numerical determination of the significance levels of the MLSLF, imply that, when the noise sequence is NID, the only parameter that must be determined empirically from the data in order to use the MLSLF is the standard deviation of the NID noise sequence itself; all other parameters can be determined independent of the specific data set in question. This is a considerable simplification over the procedure required when the distribution of the noise sequence is not known to be NID.

Finally, it should be noted that these simple analytical forms for facilitating the use of the MLSLF when the noise sequence is NID are yet another inducement for the application of the ARIMA pre-whitening transformations recommended in the preferred embodiment, so as to obtain noise sequences for which such simplifications are appropriate.

REWLS Leak Flow Estimates When Noise is Not Normally and Independently Distributed (NID)

Least squares fitting has the important property that, if the model is correct and the noise is NID (normally and independently distributed), the least squares parameter estimates extract all of the information about the unknown, fitted parameters of the model that the data may contain. Ideally, if the noise in the measured sequences of the flow imbalances is NID then the methods of REWLS discussed earlier can be applied directly to obtain highly efficient leak flow-related statistics.

However, in reality, such process noise sequences tend to have a high degree of serial dependency (SD), i.e., they are not statistically independent. Largely due to such SD, parameter estimates obtained via least squares fits made directly to such data sequences may, in worst cases, capture only a very small fraction of the information about the unknown parameters that the data actually contains.

To overcome this problem, methods of transforming such process data sequences into new sequences whose noise components are reasonably close to NID can be used. One such well-known transformation method is an ARIMA (auto regressive integrated moving average) pre-whitening transformation (See Box and Jenkins).

With regard to the REWLS system 20, using an appropriate ARIMA model describing the noise sequence encountered, an inverse ARIMA transformation is applied to obtain a new sequence that looks like NID noise. The REWLS software then fits this pre-whitened sequence to the exponential leak shapes. One of the most important aspects of using exponentially-shaped leak models is that exponential leak shapes are shape-invariant under all ARIMA transformations. This means that, when the leak event is known (or assumed for significance testing purposes) to be an exponential of unknown growth rate, the entire apparatus associated with REWLS fitting, and in particular both the MLSLF and the SMLSLF statistics (described above) can be applied to such pre-whitened data sequences in exactly the same manner as they were applied to the original sequences. Moreover, the meaning of the exponentially weighted averages of the pre-whitened sequences can be given a leak flow interpretation which is, apart from a scale factor that depends only on the ARIMA model and leak growth rate used, the same as that of the averages of the original sequence.

The general ARIMA model can be described using the backward shift operator as:

$$((1-\text{phi}_1*B-\ldots-\text{phi}_p*B^p))*\text{ARIMANoise}(t_i)=((1-\text{theta}_1*B-\text{theta}_2*B^2-\ldots-\text{theta}_q*B^q))*\text{NIDNoise}(t_i)$$

In the above, B is a backward shift operation, defined by the relationship:

$$B*z(t_i)=z(t_{i-1})$$

That is, when B is applied to any member of a sequence, it returns the preceding sequence element. Thus, the above sums are simply linear combinations of the last p observed noise sequence elements, and the last q elements of the underlying white noise sequence that "generates" the observed ARIMA noise sequence. Note that in terms of the REWLS model formulation, the observed noise sequence elements, ARIMANoise($t_i$) are the elements of the residual vectors.

When performing pre-whitening, the p previous values of the ARIMANoise($t_i$) sequence and q previous values of the NIDNoise($t_i$) sequence are stored, and the general ARIMA model is solved for NIDNoise($t_i$) each time a new value of the observed noise sequence, ARIMANoise($t_i$) becomes available; the oldest values of both sequences are discarded and the new sequence values replace them. This approach requires one to deal with the beginning of the sequence as a special case, since initially the previous values of both the ARIMA and NID noise sequences will be unknown. The most simple method is to assume that these unknown previous values are zero (which is their expected mean value). Although more refined methods are available, the simplicity of this approach often makes it the method of choice, especially since, if the first few values of the resulting pre-whitened sequence are discarded, the impact of the initialization period on the results becomes negligible. For more information about this approach, see Box and Jenkins.

Given an ARIMA model and a sufficiently long data sequence, the general ARIMA model can be applied recursively to, for any given guesses of the phi's and theta's of the model, determine the underlying NIDNoise($t_i$) sequence associated with these guesses for the unknown parameters of the model. By repeating this process with different guesses for the phi's and theta's, the "best fitting" theta's and phi's, namely, those that minimize this sum of squares, can be found. Commercial software packages, such as StatSoft's STATISTICA package, that allow one to: 1) determine the order of the ARIMA model (e.g., how big p and q should be), 2) fit such models to observed noise sequences and 3) determine how well the model explains away the serial dependency in the sequence, are widely available.

For purposes of the present invention, an important observation is that any pre-whitening ARIMA transformation leaves the exponential leak shapes of the original sequence unchanged, apart from a time independent scale factor. To see this, the auto-regressive form of the ARIMA model is employed to write NIDNoise($t_i$) as a linear combination of all past observed values:

$$\text{NIDNoise}(t_i)=\text{Sum } j=0 \text{ to infinity } \{c_j*\text{ARIMANoise}(t_{i-j})\}$$

where the $c_j$'s are constant functions of the theta's and phi's of the original ARIMA model (for a discussion of how they are related, see Box and Jenkins). When this pre-whitening transformation is applied to the original ARIMA noise sequence, an NID sequence results. When the transformation is applied in the presence of such noise and an exponential leak flow, the result is an NID noise sequence plus a pre-whitened exponential leak flow. The pre-whitened exponential leak flow component is computed below:

$$\text{PreWhitenedLeakFlow}(t_i)=\text{Sum}j=0 \text{ to infinity } \{c_j*\text{LeakFlow}(t_{i-j})\}= a*\exp(-(\text{tCurrent}-t_i)/\text{Tau}_{Leak})*\text{Sum } j=0 \text{ to infinity}\{c_j*\exp(-j*\text{dt}/\text{Tau}_{Leak})\}$$

The convergent summation in the above expression depends only upon the hypothesized leak growth rate, and on the phi's and theta's of the ARIMA model (which alone determine the $c_j$'s). It does not depend upon the time, $t_i$. Thus, apart from a constant scale factor equal to the value of this sum, ARIMA transformations do not change the hypothesized exponential leak event's shape. Intuitively, this is because exponential leak shapes, when viewed from any point in time, $t_i$, backwards, always have exactly the same shape, apart from a single scale factor equal to exp(−(tCurrent−$t_i$)/Tau. Note that the exponential is the only continuously differentiable function that has this "shape invariance" property.

Given that the leak event is as well characterized by a single exponential shape after pre-whitening as it was before pre-whitening, the above results are sufficient to prove that the REWLS methods will capture over 80% of the leak event, in a sum of squares sense. Namely, given a sequence consisting of an exponential leak and an ARIMA noise sequence of the form:

$$\text{flow}(t_i)=\text{a}a*\exp(-(\text{tCurrent}-t_i)/\text{Tau}_{Leak})+\text{ARIMANoise}(t_i)$$

then if the inverse ARIMA transformation is applied to this flow($t_i$) sequence, then the resulting model will be of the form:

$$\text{PrewhitenedFlow}(t_i)=b*\exp(-(\text{tCurrent}-t_i)/\text{Tau}_{Leak})+\text{NIDNoise}(t_i)$$

where b=K*a, and the constant K is given by:

$$K=\text{Sum } j=0 \text{ to infinity } \{c_j*\exp(-j*\text{dt}/\text{Tau}_{Leak})\}$$

where the $c_j$'s are defined as before.

Thus, if bBest is the estimate of the unknown parameter b that minimizes the sum of the squared residuals between the exponential shape and the pre-whitened sequence, the corresponding estimate of a, aBest=bBest/K, is the one that captures all of the information about the unknown leak flow rate consistent with the hypothesized exponential growth rate and process noise model. Any other leak flow rate estimate would imply a larger sum of squares, and hence a lower probability of being the true leak flow rate. Thus, if the leak event, after pre-whitening, is reasonably well modeled by the chosen exponential, the resulting least squares fits will be maximum likelihood leak flow estimates, and most of the leak related information will be extracted from the sequence.

The assumption that a single exponential can reasonably well approximate the pre-whitened leak sequence is known as the "strong leak shape heuristic", to distinguish it from the weaker assumption that the original leak sequence is merely non-decreasing. Note that, if the noise sequence is NID, the weaker assumption alone guarantees the statistical efficiency of the present invention. Applicants believe that it is reasonable to assume the strong leak shape heuristic for many, if not most, of the kinds of leaks and forms of serial dependency that arise in practice. However, it should be noted that, if a noise sequence, due to its special structure, in effect, hides the shape of the leak, this would be a handicap to any method, not just to the present method. For, given any shape model, that model can be subjected to the pre-whitening transformation associated with the noise sequence, and the resulting pre-whitened shapes fit to the pre-whitened data, as was done for the exponential leak shapes discussed previously. This will always be the best estimate of the parameters of that particular shape model, assuming the given noise model and the leak shape are valid. The problem is that, for certain forms of noise, it is precisely those features of the leak about whose "temporal profile" little or nothing is known, that are obtained after pre-whitening. That is, the statistically significant features of the noise sequence may correspond to features of the leak event about which little or no shape information is known. When this is the case, there will be no statistically efficient way of assembling the information contained in the individual, pre-whitened, sequence elements; instead, far less efficient, shape-independent, methods of pooling this information, such as the chi-squared test, are used. The statistical efficiency of such methods is so much worse than that of statistics available when a reasonable assumption about shape can be made, that it is advantageous to assume some reasonable shape.

Thus given that, for reasons of statistical efficiency, some approximate shape must be assumed, the exponential shapes, with their invariance under all ARIMA transformations, have a distinctive edge over other possible choices: regardless of how ambiguously shaped the pre-whitened leak may become, the pre-whitened exponential fitted always has the same shape and thus, at the very least, can still be interpreted as an exponentially weighted average of the pre-whitened (and indeed, as discussed above, apart from a constant multiplier, of the original) sequence. This valuable property of the exponential leak shapes is known as the "heuristic invariance":

Heuristic invariance property: With exponential leak shapes, the heuristic used to consolidate the leak related information spread over time is exactly the same for both the original, and the pre-whitened, sequence of flow imbalances. By contrast, all other shapes, when subjected to pre-whitening transformations, result in very different to-be-fitted shapes. For example, steps, when differenced, form sharp spikes; ramps, when differenced, result in square pulses, etc. The result is that the use of such "non ARIMA-invariant" shapes can result in "bizarre" shapes after pre-whitening that are highly unlikely to efficiently or reliably consolidate the information that the pre-whitened leak flow sequence contains. For example, in order to detect a step-shaped leak in the presence of random walk noise, one cannot do better than to fit the pre-whitened leak shape (a spike) to the data. The upshot is that, if the step shape is applied consistently in the presence of random walk noise, one ends up looking at only the individual differences of the sequence, with unusually large, positive differences indicating a leak. That is, one does not do any averaging of these differences. This would be the best thing to do if it were certain that the leak sought were a step. But if the leak were not a perfect step (even if the noise were perfect random walk noise) this approach would likely prove a very poor choice, because the integrating effects, useful for leaks that grow to their maximum size over several time steps, would not be obtained; conversely, it is these integrating effects that are always provided by the exponential shape heuristic, regardless of the nature of the serial dependency that the sequence contains. For similar reasons, the exponential leak shapes will also be more robust with respect to noise model mismatch errors.

If the SMLSLF is applied directly to a data sequence whose noise sequence involves serial dependency, then, as discussed above, the least squares leak flow estimates upon which the SMLSLF is based will extract less information from the data than could have been extracted if the pre-whitened sequence had been used. In general, the improvement in signal-to-noise ratio will be a complex function of the structure of the serial dependency, and the distribution of leak events (sharply growing, slowly growing, etc.) used to characterize the kinds of leaks that occur for the process system of interest. In the worst cases, such as a random walk noise sequence, without pre-whiteneing, the signal to noise ratio approaches zero regardless of leak shape. On the other extreme, there are no advantages to pre-whitening if the noise sequence is already normally and independently distributed.

Example 5

Pre-Whitening

The following example illustrates how the noise model used can impact the ability to detect leaks. Raw drum balances were formed by taking the raw measured flow imbalance (Total Feedwater Flow—Total Steam Flow—Blowdown Flow) around a recovery boiler system every second, during a leak-free period. Using time series analysis techniques, a nine parameter autoregressive model was found to provide a good characterization of this noise sequence:

$$ARIMANoise(t_i)=Sum\ k=1 \text{ to } 9\{phi_j{*}ARIMANoise(t_{i-k})\}+NID\text{-}Noise(t_i)$$

By fitting this model to the data sequence, we obtained a pre-whitening transformation for the observed noise sequence:

| | |
|---|---|
| Phi 1 | 0.646722 |
| Phi 2 | 0.300781 |
| Phi 3 | 0.169397 |
| Phi 4 | 0.088856 |
| Phi 5 | −0.00587 |
| Phi 6 | −0.02568 |
| Phi 7 | −0.08529 |
| Phi 8 | −0.06688 |
| Phi 9 | −0.05182 |

Figure 11:
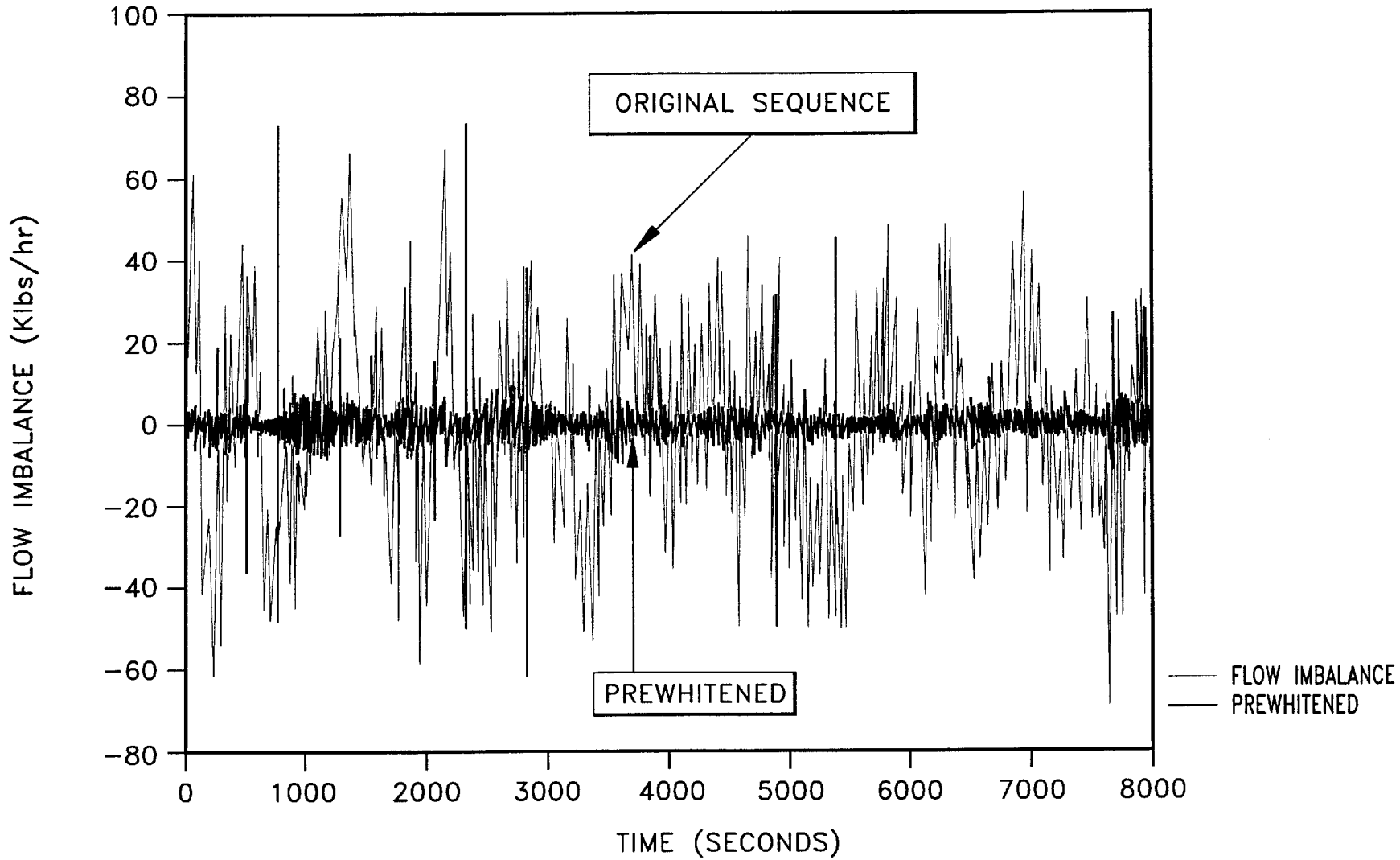
FIG. 11 depicts a graph of original flow imbalances and pre-whitened flow imbalances around a recovery boiler.

Both the original and pre-whitened flow imbalances around the boiler using this model are shown in FIG. 11.

Note that the tight, inner noise cloud represents the pre-whitened sequence whereas the undulating, wider, sequence represents the original sequence. It is apparent that the original data sequence is indeed SD: if the previous value was high, the current value has a much greater likelihood of being high, etc.

Figure 12:
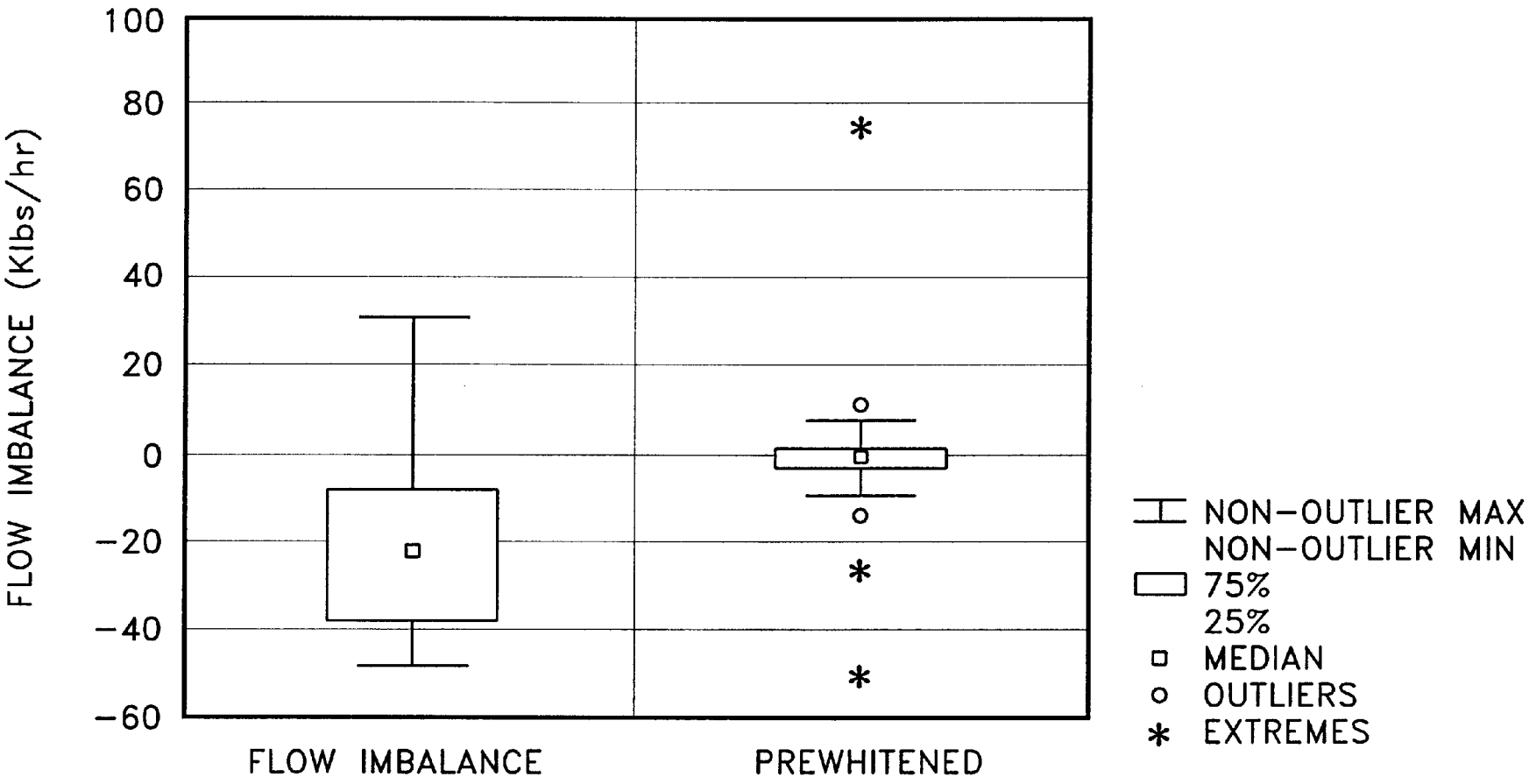
FIG. 12 depicts a depicts a graph showing the reduction of flow imbalance variability after pre-whitening.
Figure 13:
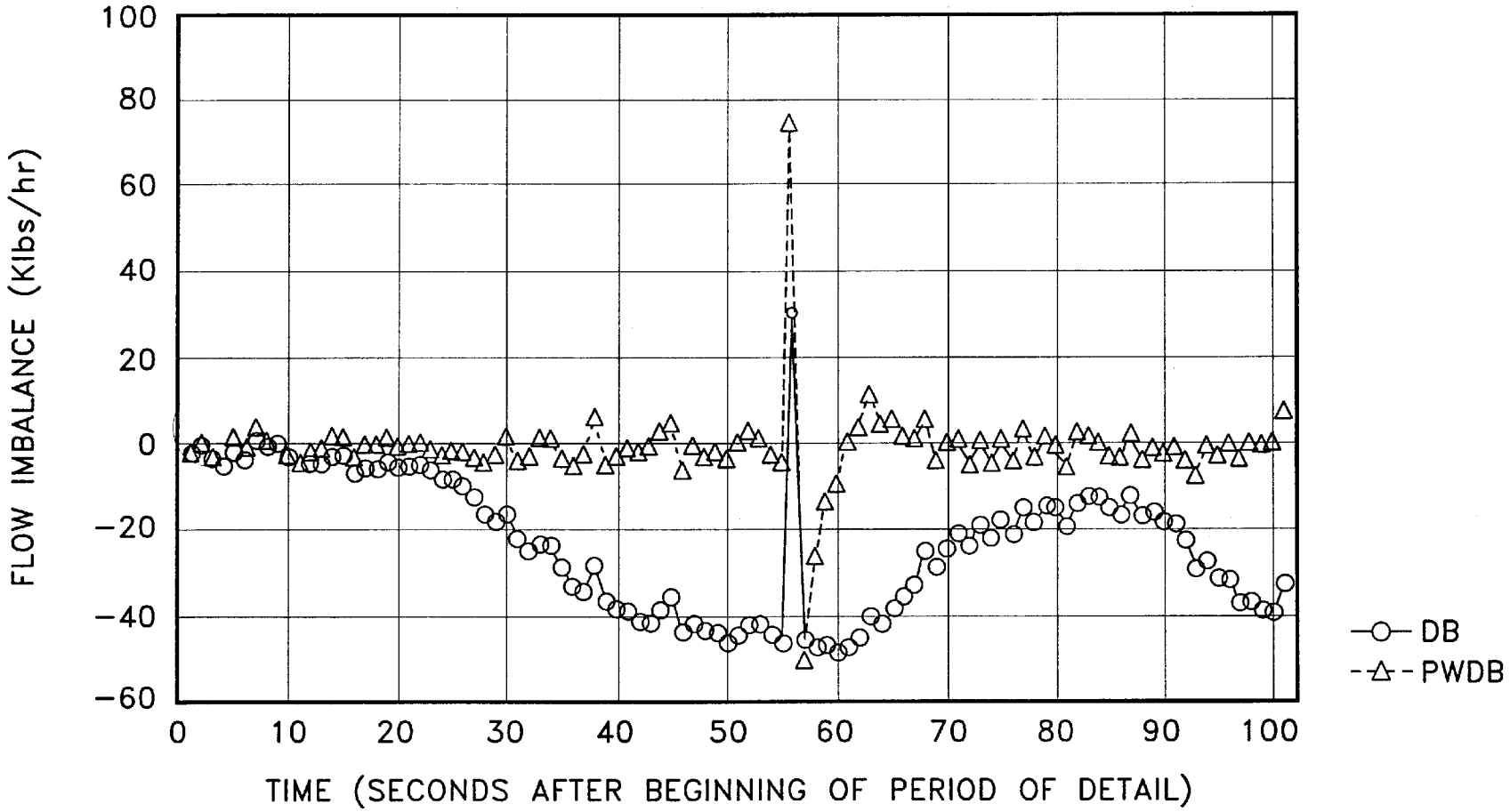
FIG. 13 depicts a graph of original flow imbalances (DB) vs. pre-whitened flow imbalances (PWDB)

The reduction in variability after pre-whitening is easier to see when the data contained in the previous graph is summarized via a box-plot as shown in FIG. 12. Pre-whitening reduces the inter-quartile range (limits between which the middle 50% of the data lie) from around 30.0 to 4.5 Klbs/hr, almost an order of magnitude reduction in variability. In addition, the median, at around −0.63, is much closer to 0.0 than the original median value of −22. This implies that the deviation of the median of the raw imbalances from zero could have been due to ordinary stochastic trends. The appearance of a small number of outliers and extreme values that were not there before pre-whitening is a direct consequence of the fact that the removal of the serially dependent component of the noise sequence allows us to "see" unusual changes that were hidden within this serially dependent noise before. To see this more clearly, FIG. 13 represents only a portion of the time sequence graph of FIG. 11 at a position near the largest of these extreme values, where DB are the drum balances without pre-whitening and PWDB are the pre-whitening drum balances.

Note that, even though both sequences contain a sharp, unusual spike, before pre-whitening, this spike does not have statistical significance because it is not particularly large relative to the peaks and valleys of ordinary "stochastic trends" in the data sequence. However, the human eye can readily observe that, even in the original sequence, the spike certainly represents an "unusual point" from a common sense point of view. Thus, the pre-whitening transformation allows something much closer to the common sense concept of "unusual values, relative to typical variability" to be reflected directly in the significance tests. That is, it permits one to distinguish between large, but not at all unusual, patterned changes in the sequence (the drifts over intervals of 100 seconds or so, which are consistent with the noise model and therefore not unusual) from changes of the same size that occur over shorter intervals and which therefore cannot be "explained away" as merely "typical stochastic drift". Note that the ability to clearly identify, and thereby more easily remove, such isolated, "bad" data points is another advantage that can be derived from pre-whitening.

It should be noted that these nearly order to magnitude increases in signal-to-noise ratio apply only when the original, pre-whitened, imbalances are used directly, without averaging (e.g., by including a TauLeak=0 in the SMLSLF) as the leak flow indicator. In some cases that arise in practice, this will not be possible because noise levels may be such that the largest possible physical leak may still be too small to detect as reasonable significance levels without at least some averaging. It can be shown that when a pre-whitened noise sequence is averaged using an EWMA, both these pre-whitened averages and the same EWMA applied to the original serially dependent sequence will have identical properties in the limit as the EWMA window (Tau) goes to infinity. Therefore, it would be expected that the improvement in signal to noise ratio associated with pre-whitening be reduced as a result of such averaging.

Figure 14:
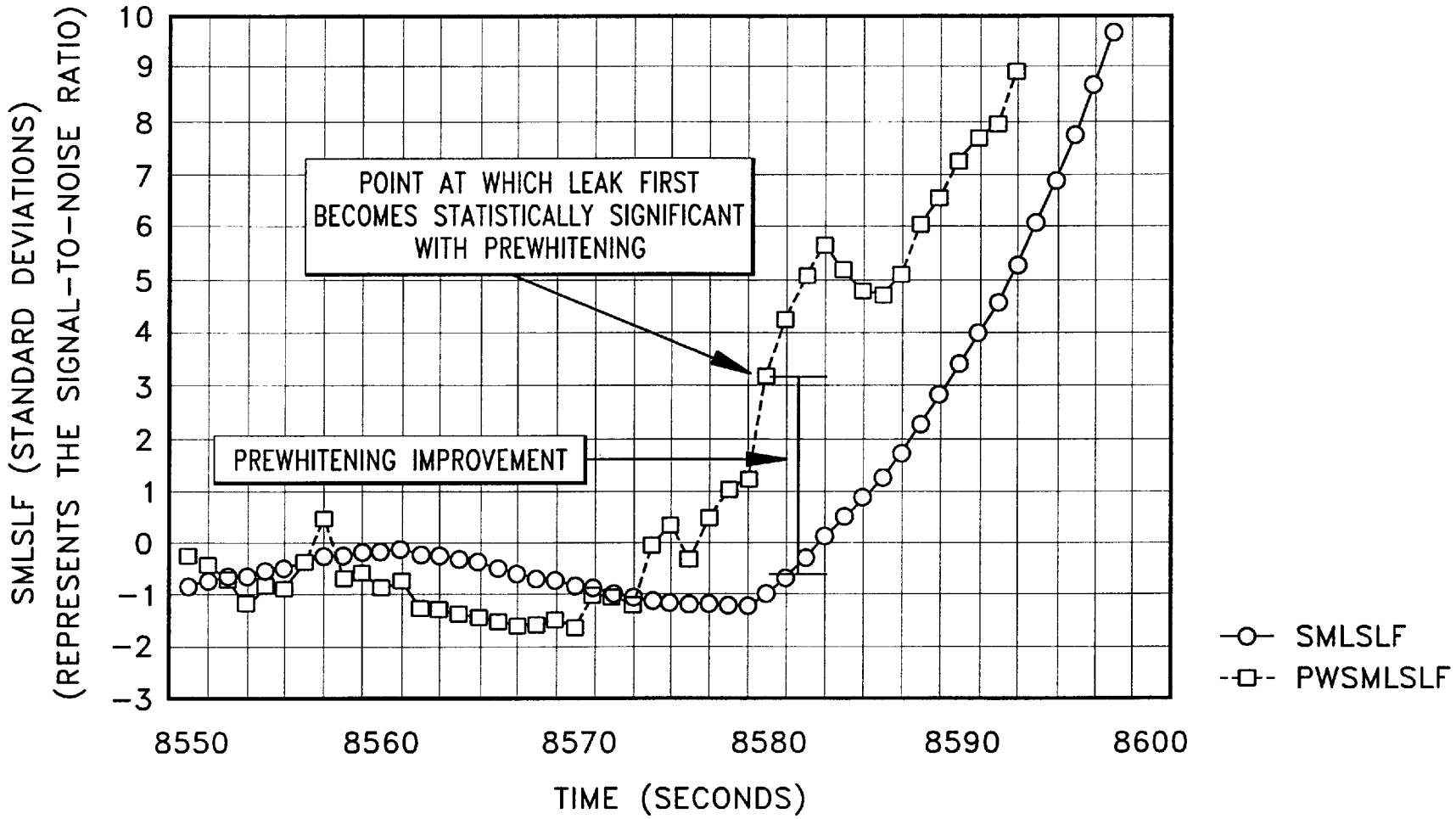
FIG. 14 depicts the SMLSLF with pre-whitening (PWSMLSLF) and the SMLSLF without pre-whitening (SMLSLF) in the presence of an exponential leak with a 10 second time constant.

To illustrate this, a simulated exponential leak with a 10 second time constant (TauLeak) is superimposed onto the observed noise sequence; the SMLSLF is then computed on both the untransformed, and pre-whitened, forms of this new sequence. Since the leak has a 10 second Tau, during the leak event, the SMLSLF will tend to choose those EWMA's that have Tau's closest to 10 seconds, thus the statistical properties of 10 second EWMA's would apply. The results, for the part of the sequence involving the exponential leak, are depicted in FIG. 14.

Note that, since the SMLSLF is a standardized statistic, it is already in the form of a signal to noise ratio, and hence the SMLSLF using the original and the pre-whitened sequences are meaningful comparative measures of statistical efficiency. Over the course of the leak, the differences between the pre-whitened and original SMLSLF, though still significant, are not nearly as pronounced as when the sequences are compared without such averaging. It should be noted that, in general, the actual advantages obtained via pre-whitening will be a complex function of the shape of the leak events seen, their size relative to the variability, the specific SMLSLF used, and the kind of serial dependency the noise sequence contains.

Figure 15:
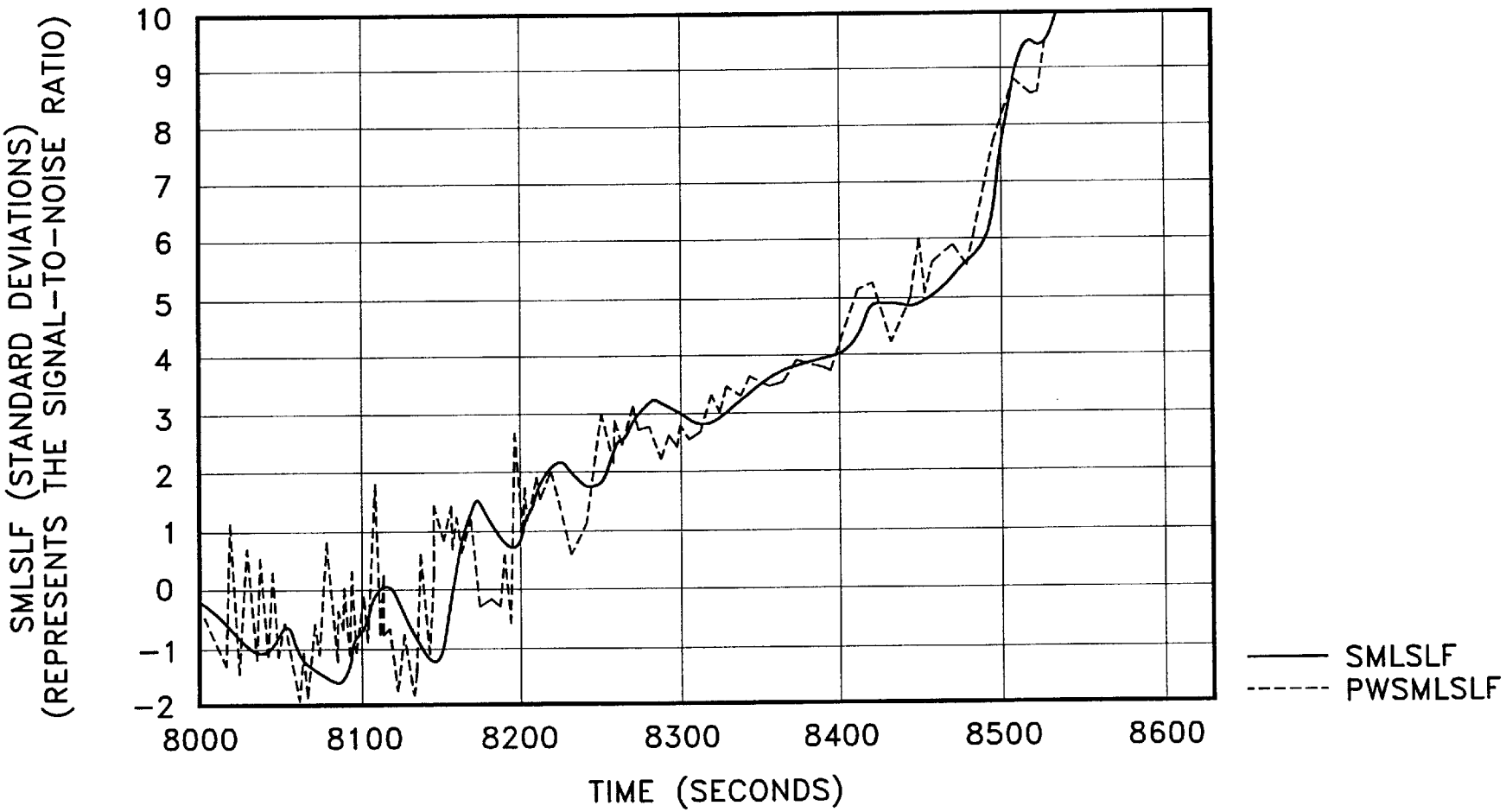
FIG. 15 depicts the SMLSLF with pre-whitening (PWSMLSLF) and the SMLSLF without pre-whitening (SMLSLF) in the presence of an exponential leak with a 100 second time constant.

Consider, for example, when happens if, instead of a leak with a 10 second tau, a leak with a 100 second Tau is superimposed onto the same data sequence, and, as before, the SMLSLF, both with and without pre-whitening, is computed, as shown in FIG. 15.

In this case, the SMLSLF automatically selects the longer term averages, since the leak is growing at a slower rate; for these longer term averages, with the form of serial dependency that this sequence contains, the pre-whitened and original SMLSLF give essentially the same result (i.e., the limiting case is approached, as discussed in the last section). Intuitively, the stochastic peaks and valleys that were so important to account for when trying to detect the faster growing leaks are averaged out with the longer term averaging required for the detection of slower growing leaks. In some special cases that arise in practice, it may be known apriori that only leaks that grow over longer periods of time are of practical interest. For example, suppose tat one could, on physical grounds, place an upper limit on the largest possible leak. Furthermore, suppose that this largest possible leak were small in comparison to the variability on a single data point. Together, these two assumptions would imply that a minimum amount of averaging ($Tau_{min}$) would always be required to detect even the largest possible leak event. In such cases, and given that the noise sequence is such that the pre-whitened and original statistics are equivalent when averages over such periods are formed (e.g., the 100 second LeakTau in the above example) one could, without information loss, omit the pre-whitening step. This would simplify the calculations needed to practice the invention.

Only in the rare occurrence where the form of serial dependency encountered was white enough and/or leaks that grew slowly enough relative to the background variability, would one be able to efficiently extract most of the leak related information without pre-whitening from the sequence of flow imbalances through the direct application of the SMLSLF to the sequence. However, in general, by using a properly pre-whitened data sequence rather than the original sequence, efficient extraction of most of the leak related information will be accomplished each time, i.e., the leak related information that the sequence contains will be extracted regardless of the form of the serial dependency, growth rate, or size, of the leak. Since the entire field of statistics known as time series analysis exists, in large measure, because the forms of serial dependency that occur in process noise sequences are many and various, and since the diverse physical causes of leaks (heat stress, chemical corrosion, physical erosion, etc.) likely give rise to an equally large variety of leak shapes and sizes, the present invention's ability to efficiently extract whatever leak related information the sequence happens to contain, independent of such factors, represents an important advance over the prior art.

Without further elaboration, the foregoing will so fully illustrate our invention that others may, by applying current or future knowledge, readily adopt the same for use under various conditions of service.

We claim:

1. A method for detecting and estimating leaks in any conserved flow around an industrial boiler wherein said conserved flow and industrial boiler form a process, said method comprising the steps of:

(a) measuring mass flow imbalances in the process to uncover any deviation from the mass flow imbalances being zero defined as variability;

(b) partitioning the variability in the measured mass flow imbalances into:

1) a process model component;

2) a leak model component; and 3) a noise component;

to form a mathematical representation of a leak in the process;

(c) utilizing a family of leak shapes for said leak model component and wherein each of said leak shapes represents a leak that is non-decreasing;

(d) applying least squares filtering to said mathematical representation by estimating unknown parameters from said measured mass flow imbalances to generate an estimated leak flow model;

(e) estimating statistical distributions of said unknown parameters to determine the statistical significance of said unknown parameters;

(f) generating a family of statistics from said family of leak shapes and wherein each of said statistics is optimized to detect a variety of leaks; and (g) combining said statistics to form a significance-testing leak statistic.

2. The method of claim 1 wherein said step of utilizing a family of leak shapes comprises utilizing a family of exponentials, and wherein each of said exponentials has a respective growth rate, for providing a range of statistics.

3. The method of claim 2 wherein said family of exponentials comprise respective exponential time constants such that the logarithms of said exponential time constants are evenly-spaced to enhance the accuracy of said leak model component.

4. The claim of claim 2 wherein said step of measuring mass flow imbalances in the process forms collected data and wherein said step of partitioning the variability comprises the application of a pre-whitening transformation to said collected data to account for any serially dependent noise.

5. The method of claim 4 wherein said optimized statistics are determined by those leak shapes having the highest probability of being associated with the leak and wherein said optimized statistics are defined as maximum likelihood standardized leak flow (MLSLF) estimates.

6. The method of claim 5 wherein said MLSLFs comprise respective distributions and wherein said step of combining said statistics to form a significance-testing leak statistic comprises determining a statistical distribution of said MLSLFs, said statistical distribution of said MLSLFs defining a standardized maximum likelihood standardized leak flow (SMLSLF) as said significance-testing leak statistic.

7. The method of claim 6 further comprising the step of empirically estimating non-modeled variation in said optimized statistics that form said MLSLFs.

8. The method of claim 6 further comprising the step of analytically estimating non-modeled variation in said optimized statistics that form said MLSLFs.

9. The method of claim 6 wherein said statistical distribution is approximated by a normal distribution by determining a standard deviation and average of said MLSLFs.

10. The method of claim 6 wherein said step of determining a statistical distribution of said MLSLFs comprises continuously selecting the best approximating shape as the leak evolves over time.

11. The method of claim 4 wherein said pre-whitening transformation comprises an auto regressive integrated moving average (ARIMA) model.

12. The method of claim 4 wherein said application of said pre-whitening transformation is conducted dynamically on-line as data is collected.

13. The method of claim 4 wherein said application of said pre-whitening transformation is conducted statically off-line using a user-selected portion of historical data.

14. The method of claim 1 wherein said step of measuring mass flow imbalances in the process forms collected data and wherein said step of partitioning the variability comprises the application of a pre-whitening transformation to said collected data to account for any serially dependent noise.

15. The method of claim 14 wherein said pre-whitening transformation comprises an auto regressive integrated moving average (ARIMA) model.

16. The method of claim 1 wherein said optimized statistics are determined by those leak shapes having the highest probability of being associated with the leak and wherein said optimized statistics are defined as maximum likelihood standardized leak flow (MLSLF) estimates.

17. The method of claim 16, wherein said MLSLFs comprise respective distributions and wherein said step of combining said statistics to form a significance-testing leak statistic comprises determining a statistical distribution of said MLSLFs, said statistical distribution of said MLSLFs defining a standardized maximum likelihood standardized leak flow (SMLSLF) as said significance-testing leak statistic.

18. The method of claim 17 wherein said statistical distribution of said MLSLFs is approximated by a normal distribution by determining a standard deviation and average of said MLSLFs.

19. The method of claim 17 wherein said step of determining a statistical distribution of said MLSLFs comprises continuously selecting the best approximating shape as the leak evolves over time.

20. The method of claim 16 further wherein said step of measuring mass flow imbalances in the process forms collected data and wherein the method further comprises the steps of:

(a) applying a pre-whitening transformation to said collected data to account for any serially-dependent noise; and (b) empirically estimating non-modeled variation in said optimized statistics that form said MLSLFs.

21. The method of claim 16 further wherein said step of measuring mass flow imbalances in the process forms collected data and wherein the method further comprises the steps of:

(a) applying a pre-whitening transformation to said collected data to account for any serially-dependent noise; and (b) analytically estimating non-modeled variation in said optimized statistics that form said MLSLFs.

22. The method of claim 1 wherein said mathematical representation comprises a vector relationship having the form, $$\Sigma v_i = \Sigma a_i * v_i + \text{residuals},$$

wherein $v_i$ is a response vector, $a_i * v_i$ is a fitted vector where $a_i$ is a value to be fitted, and said residuals is a vector defined as the difference between said response vector and the sum of said fitted vectors and where i represents an index for a plurality of response vectors.

23. The method of claim 22 wherein said step of applying least squares filtering said mathematical representation by estimating unknown parameters comprises the step of determining those values of $a_i$ such that, $$\text{Minimize: } |\text{residuals}|^2 = |\Sigma v_i - \Sigma a_i * v_i|^2.$$

24. The method of claim 22 wherein $v_i$ is expressed as a product of a measured function and at least one exponential multiplier.

25. The method of claim 24 wherein said measured function comprises a function that has been fed through an exponentially-weighted moving average.

26. The method of claim 25 wherein said measured function comprises a function that has been smoothed by an exponentially-weighted moving average.

27. The method of claim 24 wherein said measured function comprises a function that has been differentiated with respect to time.

28. The method of claim 24 further comprising the step of lagging one measured function with respect to another measured function for proper synchronization of said measured mass flow imbalances.

29. The method of claim 22 further comprising the step of more efficiently updating said least squares filtering by utilizing the dot product of two response vectors, defined by the integral of a product of said two response vectors, wherein said dot product can be approximated as an exponentially weighted sum.

30. The method of claim 29 wherein said step of more efficiently updating said least squares filtering comprises the following relationship:

$$dotproduct_{ij}(t0)=0 \text{(this initializes the dot product)},$$

$$dotproduct_{ij}(tCurrent)=exp(-(tCurrent-tPrevious)/Tau_{ij})*$$

$$dotproduct_{ij}(tPrevious)+(1-exp(-min(tCurrent-tPrevious, maxDt)/Tau_{ij}))*x_i(tCurrent)*x_j(tCurrent), \text{ and}$$

wherein tCurrent and tPrevious are the times of the current and previous measurements, maxDt is the longest time between samples before data is declared to be missing, and $Tau_{ij}=(Tau_i*Tau_j)/(Tau_i+Tau_j)$, where $Tau_i$ and $Tau_j$ are the tau's associated with the exponential weight of vectors $v_i$ and $v_j$ formed from measured sequences $x_i(t)$ and $x_j(t)$, and wherein j represents another index for said plurality of response vectors such that all possible combinations of response vectors are accounted for, including i=j.

31. The method of claim 1 wherein said step of partitioning the variability comprises process model parameterization that is conducted dynamically on-line.

32. The method of claim 1 wherein said step of partitioning the variability comprises process model parameterization that is conducted statically off-line.

33. The method claim 1 wherein said step of partitioning the variability comprises leak model parameterization that is conducted dynamically on-line.

34. The method of claim 1 wherein said step of partitioning the variability comprises leak model parameterization that is conducted statically off-line.

35. The method of claim 1 wherein said process accounts for concentration changes due to steaming rate changes.

36. The method of claim 35 wherein the industrial boiler includes a drum and wherein said process model component includes drum level process variables.

37. The method of claim 35 wherein the process includes flow meters and wherein said process model component includes flow meter miscalibrations.

38. The method of claim 1 wherein said step of estimating statistical distributions comprises computing exponentially-weighted standard deviations of said unknown parameters.

39. The method of claim 1 wherein said process includes chemical mass flow and wherein said process model component accounts for all chemical mass flows into and out of the industrial boiler.

40. The method of claim 1 wherein said process includes water mass flow and wherein said process model component accounts for all water mass flows into and out of the industrial boiler.

41. The method of claim 1 wherein said step of partitioning the variability comprises fitting parameters of said mathematical representation off-line.

42. A method for detecting and estimating leaks in any conserved flow around an industrial boiler wherein said conserved flow and industrial boiler form a process, said method comprising the steps of:

(a) measuring mass flow imbalances in the process to uncover any deviation from the mass flow imbalances being zero defined as variability;

(b) partitioning the variability in the measured mass flow imbalances into:

1) a process model component;

2) a leak model component; and 3) a noise component;

to form a mathematical representation of a leak in the process;

(c) utilizing at least one leak shape for said leak model component and wherein said at least one leak shape represents a leak that is non-decreasing;

(d) applying least squares filtering to said mathematical representation by estimating unknown parameters from said measured mass flow imbalances to generate an estimated leak flow model;

(e) estimating statistical distributions of said unknown parameters to determine the statistical significance of said unknown parameters; and (f) generating statistics from said at least one leak shape to detect a leak.

43. The method of claim 42 further comprising the step of combining said statistics to from a significance-testing leak statistic.

44. A system for detecting and estimating leaks in any conserved flow around an industrial boiler wherein said conserved flow and industrial boiler form a process, said system comprising:

(a) means for measuring mass flow imbalances in the process;

(b) means for modeling a mathematical representation of a leak in the process, said mathematical representation comprising a process model component, a leak model component and a noise component, said modeling means utilizing a family of leak shapes for said leak model component and wherein each of said leak shapes represents a leak that is non-decreasing;

(c) means for applying least squares filtering to said mathematical representation by estimating unknown parameters from said mass flow imbalances in order to generate an estimated leak flow model;

(d) means for estimating statistical distributions of said unknown parameters to determine statistical significance of said unknown parameters;

(e) means for generating a family of statistics from said family of leak shapes, wherein each of said statistics is optimized to detect a variety of leaks; and (f) wherein said means for generating a family of statistics combines said statistics to form a single significance-testing leak statistic.

45. The system of claim 44 wherein said modeling means uses a family of exponentials having respective growth rates for said family of leak shapes to provide a range of statistics.

46. The system of claim 45 wherein said family of exponentials comprise respective exponential time constants such that the logarithms of said exponential time constants are evenly-spaced to enhance the accuracy of said leak model component.

47. The system of claim 45 wherein said measured mass flow imbalances form collected data and wherein said system further comprises pre-whitening transforming means, said collected data being fed into said pre-whitening transforming means to account for any serially dependent noise.

48. The system of claim 47 wherein said pre-whitening transforming means comprises an auto regressive integrated moving average (ARIMA) model.

49. The system of claim 44 wherein said measured mass flow imbalances form collected data and wherein said system further comprises pre-whitening transforming means, said collected data being fed into said pre-whitening transforming means to account for any serially dependent noise.

50. The system of claim 49 wherein said means for generating a family of statistics generates said optimized statistics based on those leaks shapes having the highest probability of being associated with the leak and wherein said optimized statistics are maximum likelihood standardized leak flow (MLSLF) estimates, said MLSLFs having respective distributions.

51. The system of claim 50 wherein said means for generating a family of statistics determines a statistical distribution of said MLSLFs to form a standardized maximum likelihood standardized leak flow (SMLSLF) statistic as said significance-testing leak statistic.

52. The system of claim 49 wherein said pre-whitening transforming means comprises an auto regressive integrated moving average (ARIMA) model.

53. The system of claim 44 wherein said means for generating a family of statistics generates said optimized statistics based on those leak shapes having the highest probability of being associated with the leak and wherein said optimized statistics are defined as maximum likelihood standardized leak flow (MLSLF) estimates.

54. The system of claim 53 wherein said means for generating a family of statistics determines a statistical distribution of said MLSLFs to form a standardized maximum likelihood standardized leak flow (SMLSLF) statistic as said significance-testing leak statistic.

55. The system of claim 54 wherein said statistical distribution is approximated by a normal distribution by determining a standard deviation and average of said MLSLFs.

56. The system of claim 54 wherein said means for generating a family of statistics continuously selects the best approximating shape as the leak evolves over time.

57. The system of claim 53 wherein the measured mass flow imbalances forms collected data and wherein said system further comprises pre-whitening transformation means for processing said collected data to account for any serially dependent noise and wherein said means for estimating statistical distributions of said unknown parameters empirically estimates non-modeled variation in said optimized statistics that form said MLSLFs.

58. The system of claim 57 wherein said pre-whitening transformation means operates dynamically on-line as data is collected.

59. The system of claim 57 wherein said pre-whitening transformation means operates statically off-line using a user-selected portion of historical data.

60. The system of claim 53 wherein the measured mass flow imbalances forms collected data and wherein said system further comprise pre-whitening transformation means for processing said collected data to account for any serially dependent noise and wherein said means for estimating statistical distributions of said unknown parameters analytically estimates non-modeled variation in said optimized statistics that form said MLSLFs.

61. The system of claim 51 wherein said means for generating a family of statistics continuously selects the best approximating shape as the leak evolves over time.

62. The system of claim 44 wherein said mathematical representation comprises a vector relationship having the form, $$\Sigma v_i = \Sigma a_i * v_i + \text{residuals},$$

wherein $v_i$ is a response vector, $a_i * v_i$ is a fitted vector where $a_i$ is a value to be fitted, and said residuals is a vector defined as the difference between said response vector and the sum of said fitted vectors and where i represents an index for a plurality of response vectors.

63. The system of claim 62 wherein said means for applying least squares filtering determine those values of $a_i$ such that, $$\text{Minimize: } |\text{residuals}|^2 = |\Sigma v_i - \Sigma a_i * v_i|^2.$$

64. The system of claim 62 wherein $v_i$ is expressed as a product of a measured function and at least one exponential multiplier.

65. The system of claim 64 wherein said measured function comprises a function that has been fed through an exponentially-weighted moving average.

66. The system of claim 64 wherein said measured function comprises a function that has been smoothed by an exponentially-weighed moving average.

67. The system of claim 64 wherein said measured function comprises a function that has been differentiated with respect to time.

68. The system of claim 64 further comprising means for lagging one measured function with respect to another measured function for proper synchronization of said measured mass flow imbalances.

69. The system of claim 62 wherein said means for applying least squares filtering further comprises means for more efficiently updating said least squares filtering by utilizing the dot product of two response vectors, defined by the integral of a product of said two response vectors, wherein said dot product can be approximated as an exponentially weighted sum.

70. The system of claim 69 wherein said means for more efficiently updating said least squares filtering utilizes the following relationship:

$$dotproduct_{ij}(t0)=0 \text{(this initializes the dot product)},$$

$$dotproduct_{ij}(tCurrent)=exp(-(tCurrent-tPrevious)/Tau_{ij})*$$

$$dotproduct_{ij}(tPrevious)+(1-exp(-min(tCurrent-tPrevious, maxDt)/Tau_{ij}))*x_i)(tCurrent)*x_j(tCurrent), \text{ and}$$

wherein tCurrent and tPrevious are the times of the current and previous measurements, maxDt is the longest time between samples before data is declared to be missing, and $Tau_{ij}=(Tau_i*Tau_j)/(Tau_i+Tau_j)$, where $Tau_i$ and $Tau_j$ are the tau's associated with the exponential weight of vectors $v_i$ and $v_j$ formed from measured sequences $x_i(t)$ and $x_j(t)$, and wherein j represents another index for said plurality of response vectors such that all possible combinations of response vectors are accounted for including i=j.

71. The system of claim 44 wherein said modeling means parameterizes said process model component dynamically on-line.

72. The system of claim 44 wherein said modeling means parameterizes said process model component statically off-line.

73. The system of claim 44 wherein said modeling means parameterizes said leak model component dynamically on-line.

74. The system of claim 44 wherein said modeling means parameterizes said leak model component statically off-line.

75. The system of claim 44 wherein said means for estimating statistical distributions comprises computing exponentially-weighted standard deviations of said unknown parameters.

76. The system of claim 44 wherein said modeling means further comprises means for accounting for concentration changes due to steaming rate changes.

77. The system of claim 76 wherein the industrial boiler comprises a drum and wherein said process model component includes drum level process variables.

78. The system of claim 76 wherein the process includes flow meters and wherein said process model component includes flow meter miscalibrations.

79. The system of claim 44 further comprising means for determining all chemical flows into and out of the industrial boiler.

80. The system of claim 79 wherein the industrial boiler comprises a non-volatile chemical mass input flow into a feedwater into the boiler fluid and wherein said industrial boiler further comprises a blowdown flow and wherein said means for measuring mass flow imbalances comprises means for measuring the non-volatile chemical mass flow in the blowdown flow.

81. The system of claim 80 wherein said feedwater comprises a chemical pump and a chemical feed pump controller, said chemical feed pump controller coupled to said means for applying least squares filtering for providing non-volatile chemical feed mass flow rate to said means for applying least squares filtering.

82. The system of claim 44 further comprising means for determining all water mass balance flows into and out of the industrial boiler.

83. The system of claim 82 wherein the industrial boiler comprises a boiler fluid, a steam flow and a blowdown flow and wherein said means for measuring mass flow imbalances comprises blowdown flow measuring means, steam flow measuring means and feedwater flow measuring means.

84. The system of claim 44 wherein said modeling means determines said mathematical representation off-line.

85. The system of claim 44 wherein said modeling means, said means for applying least squares filtering, said means for estimating statistical distributions and said means for generating a family of statistics reside in a computer.

86. A system for detecting and estimating leaks in any conserved flow around an industrial boiler wherein said conserved flow and industrial boiler form a process, said system comprising:

(a) means for measuring mass flow imbalances in the process;

(b) means for modeling a mathematical representation of a leak in the process, said mathematical representation comprising a process model component, a leak model component and a noise component, said modeling means utilizing at least one leak shape for said leak model component and wherein said at least one leak shape represents a leak that is non-decreasing;

(c) means for applying least squares filtering to said mathematical representation by estimating unknown parameters from said mass flow imbalances in order to generate an estimated leak flow model;

(d) means for estimating statistical distributions of said unknown parameters to determine statistical significance of said unknown parameters; and (e) means for generating statistics from said at least one leak shape to detect a leak.

87. The system of claim 86 wherein said generating means combines said statistics to form a single significance-testing leak statistic.

* * * * *

UNITED STATES PATENT AND TRADEMARK OFFICE

CERTIFICATE OF CORRECTION

PATENT NO. : 6,076,048 
DATED : June 13, 2000
INVENTOR(S) : John C. Gunther, Ke Hong, Paul R. Burgmayer, Haiwen Chen & Virginia E. Durham It is certified that error appears in the above-identified patent and that said Letters Patent is hereby corrected as shown below:

On the title page of the above-identified patent, under item (56) References Cited, replace the listed reference with the following:

-- U.S. Patent Documents

| | | | |
|---|---|---|---|
| 4,897,797 | 1/1990 | Free, Jr., et al. | 364/528.01 |
| 5,304,800 | 4/1994 | Hoots, et al. | 250/302 |
| 5,315,530 | 5/1994 | Gerhardt, et al. | 395/500.3 |
| 5,320,967 | 6/1994 | Avallone, et al. | 436/50 |
| 5,363,693 | 11/1994 | Nevruz | 73/40.5R |
| 5,471,400 | 11/1995 | Smalley, et al. | 395/500.3 |
| 5,565,619 | 10/1996 | Thungstrom, et al. | 73/40.7 |
| 5,663,489 | 9/1997 | Thungstrom, et al. | 73/40.7 |
| 5,756,880 | 5/1998 | Chen, et al. | 73/40 |

OTHER PUBLICATIONS

An Expert System for Detecting Leaks in Recovery-Boiler Tubes, Tappi Journal, June 1992, pp. 147-152 by Racine and Borsje Design and Implementation of a Commercial Acoustic Leak-Detection System for Black Liquor Recovery Boilers, Tappi Journal, July 1990 by Buckner and Paradis A Proven and Patented Method to Detect Small Leaks in the Recovery Boiler Tappi Engineering Conference 1995, pp. 479-484 by Nevruz Introduction: Problem: A boiler-tube Leak Can Lead to a Catastrophic Smelt-Water Explosion in the Lower Section of the Recovery Boiler (RB), Union Camp Corporation Presentation 1996, pp. 1-24 --.

UNITED STATES PATENT AND TRADEMARK OFFICE

CERTIFICATE OF CORRECTION

PATENT NO. : 6,076,048 
DATED : June 13, 2000
INVENTOR(S) : John C. Gunther, Ke Hong, Paul R. Burgmayer, Haiwen Chen & Virginia E. Durham It is certified that error appears in the above-identified patent and that said Letters Patent is hereby corrected as shown below:

On the title page of the above-identified patent, under item (57) Abstract, replace Lines 8-11 with the following:

--tation. This invention provides a variety of leak flow estimates and associated significance tests that have a much higher statistical efficiency and are sensitive to leaks with a wider range of leak growth rates than prior approaches.--

Signed and Sealed this

Seventh Day of August, 2001

Nicholas P. Godici

*Attest:*

*Attesting Officer*

NICHOLAS P. GODICI
*Acting Director of the United States Patent and Trademark Office*